US007401711B2

(12) United States Patent
Spivey, Sr.

(10) Patent No.: US 7,401,711 B2
(45) Date of Patent: Jul. 22, 2008

(54) CARTON HAVING IMPROVED OPENING FEATURES

(75) Inventor: Raymond Rudolph Spivey, Sr., Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 235 days.

(21) Appl. No.: 11/261,024

(22) Filed: Oct. 28, 2005

(65) Prior Publication Data

US 2006/0071058 A1 Apr. 6, 2006

Related U.S. Application Data

(63) Continuation-in-part of application No. 11/054,629, filed on Feb. 9, 2005.

(60) Provisional application No. 60/623,497, filed on Oct. 29, 2004, provisional application No. 60/543,382, filed on Feb. 10, 2004.

(51) Int. Cl.
*A47F 1/04* (2006.01)

(52) U.S. Cl. ..... 221/305; 221/303

(58) Field of Classification Search ..... 221/305
See application file for complete search history.

(56) References Cited

U.S. PATENT DOCUMENTS

| | | | | |
|---|---|---|---|---|
| 902,347 | A | 10/1908 | Tillinghast | |
| 1,541,143 | A | 6/1925 | Hoile | 229/231 |
| 1,925,102 | A * | 9/1933 | Levkoff | 206/746 |
| 2,124,808 | A | 7/1938 | White et al. | 229/27 |
| 2,448,819 | A | 9/1948 | Mitchell | 206/57 |
| 2,473,635 | A | 6/1949 | Buttery | 206/45.26 |

(Continued)

FOREIGN PATENT DOCUMENTS

| | | | |
|---|---|---|---|
| CA | 874828 | 7/1971 | 221/14 |

(Continued)

OTHER PUBLICATIONS

"Dispensing Multipack, Coke Canner Rolls Out 'Fridge-Friendly' Pack," Packaging World, Sep. 2001, p. 2, [Summit Publishing Company—Chicago].

(Continued)

*Primary Examiner*—Gene O. Crawford
*Assistant Examiner*—Timothy R Waggoner
(74) *Attorney, Agent, or Firm*—Womble Carlyle Sandridge & Rice, PLLC

(57) ABSTRACT

A blank capable of being formed into a carton for enclosing a plurality of containers that includes a first side panel, a top panel, a second side panel, a bottom panel, an adhesive flap, at least one first end flap extending along a first marginal area of the blank, and at least one second end flap extending along a second marginal area of the blank. A tear line is formed in the top panel, the first side panel, and the second side panel. In some embodiments, the tear line in each side panel extends perpendicular from the top panel and continues to at least one turn to proceed into side panel end flaps. One or more stair steps can be included in each side panel along the tear line. Separation of a detachable portion from the carton along the tear line creates an opening through which the containers can be removed.

14 Claims, 15 Drawing Sheets

U.S. PATENT DOCUMENTS

| | | | | |
|---|---|---|---|---|
| 2,718,301 | A | 9/1955 | Palmer | 206/65 |
| 2,723,027 | A | 11/1955 | Guyer | 206/65 |
| 2,730,232 | A | 1/1956 | Coe | 206/45.26 |
| 2,754,047 | A | 7/1956 | Schmidt et al. | 229/51 |
| 2,842,304 | A | 7/1958 | Ringler | 229/51 |
| 2,868,431 | A | 1/1959 | Painter | 229/51 |
| 2,919,844 | A | 1/1960 | Anderson. Jr. | 229/28 |
| 2,930,516 | A | 3/1960 | Fowle et al. | 229/7 |
| 2,975,891 | A | 3/1961 | Stone | 206/65 |
| 2,990,097 | A | 6/1961 | Thompson | 229/20 |
| 3,002,651 | A | 10/1961 | Gauld | 221/34 |
| 3,018,031 | A | 1/1962 | Ahlbor et al. | 229/44 |
| 3,178,242 | A * | 4/1965 | Ellis et al. | 221/67 |
| 3,228,582 | A * | 1/1966 | Osberg | 229/238 |
| 3,263,861 | A | 8/1966 | Carr | 221/302 |
| 3,265,283 | A | 8/1966 | Farquhar | 229/27 |
| RE26,083 | E | 9/1966 | Forrer | 220/115 |
| 3,300,115 | A | 1/1967 | Schauer | 229/27 |
| 3,332,594 | A | 7/1967 | Capua | 224/15 |
| 3,356,279 | A | 12/1967 | Root | 229/17 |
| 3,517,858 | A | 6/1970 | Farquhar | 221/305 |
| 3,540,581 | A | 11/1970 | Koolnis | 206/193 |
| 3,599,858 | A | 8/1971 | Samsing | 229/51 |
| 3,669,251 | A | 6/1972 | Phillips | 206/44 |
| 3,765,327 | A | 10/1973 | Vargo | 101/232 |
| 3,765,527 | A | 10/1973 | Vargo | 206/44 |
| 3,894,681 | A | 7/1975 | Ameson et al. | 221/305 |
| 3,913,739 | A | 10/1975 | Hennessey | 206/434 |
| 3,942,631 | A | 3/1976 | Sutherland et al. | 206/44.12 |
| 4,000,811 | A | 1/1977 | Hardison et al. | 229/242 |
| D243,508 | S | 3/1977 | Killy | D9/245 |
| 4,030,596 | A | 6/1977 | Snyder et al. | 206/45.26 |
| D252,259 | S | 7/1979 | Rinehart | D9/245 |
| 4,214,660 | A | 7/1980 | Hunt, Jr. | 206/427 |
| 4,216,861 | A | 8/1980 | Oliff | 206/427 |
| 4,222,485 | A | 9/1980 | Focke | 206/141 |
| D263,204 | S | 3/1982 | Dutcher | D9/433 |
| 4,325,482 | A | 4/1982 | Feeser | 206/625 |
| 4,364,509 | A | 12/1982 | Holley, Jr. et al. | 229/95 |
| 4,375,258 | A | 3/1983 | Crayne et al. | 432/141 |
| D269,068 | S | 5/1983 | Mann et al. | D9/416 |
| D270,041 | S | 8/1983 | Vestal | D9/416 |
| 4,396,143 | A | 8/1983 | Killy | 221/305 |
| 4,416,410 | A | 11/1983 | Herrmann | 229/38 |
| 4,417,661 | A | 11/1983 | Roccaforte | 229/232 |
| 4,465,180 | A | 8/1984 | Klygis | 206/158 |
| 4,498,581 | A | 2/1985 | Dutcher | 206/427 |
| 4,582,199 | A | 4/1986 | Schuster | 206/428 |
| D286,987 | S | 12/1986 | Golan et al. | D9/433 |
| 4,726,471 | A | 2/1988 | Whately et al. | 206/554 |
| 4,756,419 | A | 7/1988 | Le Bras | 206/430 |
| 4,785,991 | A | 11/1988 | Schuster | 229/52 |
| 4,817,866 | A | 4/1989 | Wonnacott | 206/427 |
| D303,090 | S | 8/1989 | Armor et al. | D9/433 |
| 4,860,944 | A | 8/1989 | Wonnacott | 229/52 |
| 4,919,266 | A | 4/1990 | McIntosh, Jr. et al. | 206/434 |
| 4,966,324 | A | 10/1990 | Steel | 229/117.13 |
| 4,972,991 | A | 11/1990 | Schuster | 229/117.13 |
| 4,974,771 | A | 12/1990 | Lavery | 229/117.13 |
| 4,981,253 | A | 1/1991 | Quaintance | 229/117.13 |
| 5,002,186 | A | 3/1991 | Cooper | 206/433 |
| 5,031,825 | A | 7/1991 | Romagnoli | 229/160.1 |
| 5,067,615 | A | 11/1991 | Davitian | 229/230 |
| 5,101,642 | A | 4/1992 | Alexandrov | 62/371 |
| 5,123,589 | A | 6/1992 | Cote | 229/232 |
| 5,137,211 | A | 8/1992 | Summer et al. | 229/164 |
| 5,170,934 | A | 12/1992 | Lemoine | 229/101 |
| D332,915 | S | 2/1993 | Hoell et al. | D9/346 |
| 5,277,360 | A | 1/1994 | DeMott | 229/122 |
| 5,279,440 | A | 1/1994 | Fougeres et al. | 220/228 |
| 5,284,292 | A | 2/1994 | Johnson | 229/122.1 |
| 5,333,734 | A | 8/1994 | Stout et al. | 206/427 |
| 5,368,194 | A | 11/1994 | Oliff et al. | 221/305 |
| 5,427,242 | A | 6/1995 | Oliff et al. | 206/430 |
| 5,465,831 | A | 11/1995 | Smith | 206/44 |
| 5,505,372 | A | 4/1996 | Edson | 229/121 |
| 5,518,111 | A | 5/1996 | Stout | 206/160 |
| 5,622,309 | A | 4/1997 | Matsuda et al. | 229/243 |
| 5,722,584 | A | 3/1998 | Fujiwara | 229/120.15 |
| 5,775,574 | A | 7/1998 | Whitnell | 229/120.18 |
| 5,788,117 | A | 8/1998 | Zimmanck | 221/285 |
| 5,826,783 | A | 10/1998 | Stout | 229/120.32 |
| 5,833,118 | A | 11/1998 | Weiss | 221/309 |
| 5,873,515 | A | 2/1999 | Dunn et al. | 229/117.13 |
| 5,878,947 | A | 3/1999 | Hoy et al. | 229/122.1 |
| 5,881,884 | A | 3/1999 | Podosek | 206/774 |
| 6,105,854 | A | 8/2000 | Spivey | 229/122.1 |
| D436,859 | S | 1/2001 | Botsford et al. | D9/416 |
| 6,176,419 | B1 | 1/2001 | Holley, Jr. | 229/122.1 |
| 6,283,293 | B1 | 9/2001 | Lingamfelter | 206/427 |
| D454,784 | S | 3/2002 | Oram | D9/416 |
| 6,386,369 | B2 | 5/2002 | Yuhas et al. | 206/746 |
| 6,435,351 | B1 | 8/2002 | Gibb | 206/736 |
| 6,478,219 | B1 | 11/2002 | Holley, Jr. | 229/240 |
| 6,484,903 | B2 | 11/2002 | Spivey et al. | 221/303 |
| 6,550,615 | B2 | 4/2003 | Lingamfelter | 206/427 |
| 6,578,736 | B2 | 6/2003 | Spivey et al. | 221/305 |
| 6,631,803 | B2 | 10/2003 | Rhodes et al. | 206/427 |
| 6,669,083 | B2 | 12/2003 | Bates | 229/240 |
| 6,715,639 | B2 | 4/2004 | Spivey | 221/305 |
| 6,729,475 | B2 * | 5/2004 | Yuhas et al. | 206/746 |
| 2002/0070139 | A1 | 6/2002 | Bates | 206/426 |
| 2003/0141353 | A1 | 7/2003 | Wilson | 229/103.2 |
| 2004/0099558 | A1 | 5/2004 | Oliff et al. | |
| 2004/0188509 | A1 | 9/2004 | Holley, Jr. | |
| 2005/0178687 | A1 | 8/2005 | Spivey, Sr. | |
| 2005/0189405 | A1 | 9/2005 | Gomes et al. | |

FOREIGN PATENT DOCUMENTS

| | | | |
|---|---|---|---|
| CA | 2246020 | | 8/1998 |
| DE | 2 323 589 | A | 5/1973 |
| DE | 75 10 538 | | 8/1975 |
| DE | 76 06 493 | U1 | 6/1976 |
| DE | 29 33 022 | C2 | 8/1979 |
| DE | 30 07 769 | C2 | 2/1980 |
| DE | 81 35 176.3 | | 11/1981 |
| DE | 85 14 718.4 | | 8/1985 |
| DE | 86 29 664.7 | | 11/1986 |
| DE | 3612594 | A1 | 10/1987 |
| DE | 40 23 043 | A1 | 7/1990 |
| DE | 94 12 885.5 | | 8/1994 |
| DE | 94 13 813.3 | | 8/1994 |
| DE | 694 21 620 | T2 | 8/1994 |
| DE | 295 19 931 | U1 | 12/1995 |
| DE | 296 02 010 | U1 | 2/1996 |
| DE | 299 09 008 | U1 | 5/1999 |
| DE | 29913585 | U1 | 8/1999 |
| EP | 235 852 | B1 | 2/1987 |
| EP | 0 323 596 | A1 | 12/1988 |
| EP | 342 088 | B1 | 4/1989 |
| EP | 0 475 147 | A1 | 8/1991 |
| EP | 659 143 | B1 | 6/1994 |
| EP | 752 370 | A2 | 7/1995 |
| EP | 936 995 | B1 | 11/1997 |
| EP | 0849189 | A1 | 6/1998 |
| EP | 1 060 998 | A2 | 6/2000 |
| FR | 2 716 437 | | 8/1995 |
| GB | 2 186 550 | A | 8/1987 |
| GB | 2 189 223 | | 10/1987 |
| JP | 7-9721 | | 7/1993 |
| WO | WO 88/09750 | | 6/1988 |
| WO | WO 95/25668 | | 3/1994 |
| WO | WO 96/29260 | | 9/1996 |

| | | | |
|---|---|---|---|
| WO | WO 97/21607 | | 6/1997 |
| WO | WO 98/31593 | | 12/1997 |
| WO | WO 99/64301 | | 6/1998 |
| WO | WO 00/23334 | | 10/1999 |
| WO | WO 00/71428 | A1 | 5/2000 |
| WO | WO 01/28871 | A1 | 4/2001 |
| WO | WO 02/04302 | A1 | 1/2002 |
| WO | WO 02/085739 | A1 | 10/2002 |

OTHER PUBLICATIONS

"Hot Hit With Consumers," International Bottler & Packer, Nov. 2001 [Binstead Publications Ltd.].

"Coke Bottler Tests A Slimmer Soda Package", Wall Street Journal B3 (Aug. 10, 2001).

"Passing the Torch", BeverageWorld p. 36 (Oct. 2002).

"Riverwood" For the Carton Designated as 'Fridge Pack,' International Bottler & Packer, Nov. 2001 [Binstead Publications Limited—United Kingdom].

"Coca-Cola Fridge Mate", p. 3 Revise Woolworth's Advertisement wca4000 / NIA.

* cited by examiner

CARTON HAVING IMPROVED OPENING FEATURES

CROSS-REFERENCE TO RELATED APPLICATION

This application claims the benefit of U.S. Provisional Patent Application Ser. No. 60/623,497, filed Oct. 29, 2004, and is a continuation-in-part of U.S. Nonprovisional Application Ser. No. 11/054,629, filed Feb. 9, 2005, which claims the benefit of U.S. Provisional Patent Application Ser. No. 60/543,382, filed Feb. 10, 2004, the entire contents of the applications being hereby incorporated by reference as if repeated in their entirety.

FIELD OF THE INVENTION

The present invention relates to cartons for holding articles and for creating openings that allow access to articles stored therewithin. More specifically, the present invention relates to cartons having opening features.

BACKGROUND OF THE INVENTION

Enclosed cartons with opening features and cartons with positioning features for displaying and enhancing dispensing of articles have been used in the past. Cartons with positioning features typically require the user to detach a portion of the carton, to manipulate the carton to assemble the positioning assembly, and to place the assembly under the carton. Once the positioning feature is removed from the carton, the user cannot replace the positioning feature to reclose the carton. Other cartons include positioning features that require adhesives to hold the positioning assembly in place or to adhere the positioning assembly to the carton itself. Still other cartons require the user to insert the positioning assembly into pre-formed slots in the carton. In many instances, after the user engages the positioning assembly, the structural integrity of the carton is lessened or destroyed. Additionally, several prior positioning assemblies are structurally weak and are easily flattened by excessive weight.

SUMMARY OF THE INVENTION

The present invention generally relates to a carton with an opening feature that forms an opening to dispense articles from the carton. In accordance with one embodiment of the invention, the opening feature can be created by a tear line, a series of tear lines, cuts, or nicks, or other lines of disruption that provide hingeable or detachable portions of the enclosed cartons that are capable of creating an opening for removing articles from the carton. The opening created by the separation of the tear line can, in one embodiment, include a substantially rectangular-shaped opening that extends from a top panel into a side panel and turns at approximately a 90-degree (90°) angle to extend into and along an end panel flap. The tear line generally extends from the top panel into the opposite side panels and turns at approximately a 90° angle and extends into and along the corresponding side panel end flaps.

Once the blank is formed into an enclosed carton, such as a parallelepiped or 6-faced polyhedron whose faces are parallelograms lying in pairs of parallel planes, the opening can be created by severing the tear line and detaching portions of the top panel, side panels, and exiting end panels. The detached portions can remain hinged to the cartons for reclosure or can be severed along the tear line for removal from the carton.

In another embodiment, the tear line can extend from the top panel into each side panel to a first step portion where the tear line extends for a desired step run distance, then turns at approximately 90° to extend a desired step rise distance to again turn at approximately 90° and thereafter extend into and through the respective side panel end flaps.

In another embodiment, the tear line can extend into both side panels a desired distance to a first step portion, where it is turned at approximately 90° and extends a first step run distance, after which it turns at approximately 90° to extend a first step rise distance. The tear line can then be further turned at approximately 90° so as to extend a second step run distance to then turn at approximately 90° and extend a second step rise distance to turn at approximately 90° and extend into and through the side panel end flaps. The turns executed by the tear line at each step portion can be substantially perpendicular in the rise and run distances, but typically will encompass approximate 90-degree angles within the range of about 80 to 95 degree turns.

In still another embodiment, the tear line can extend from the top panel into each side panel to turn at approximately a 90-degree (90°) angle to extend into and through an end panel flap a desired first distance and then can extend at a generally oblique angle a desired second distance after which it again turns and extends toward the end of the side panel end flaps.

In yet another embodiment, the tear line can extend from the top panel a distance into one or both of the side panels and turns at an oblique angle so as to extend into the side panel end flaps a distance. The tear line then can turn and extend at a steeper oblique angle a desired distance to a point where it turns and extends to the end of the side panel end flaps. This, and other embodiments identified herein, can include positioning features, such as those detailed in U.S. patent application Ser. No. 11/054,629, the disclosure and figures of which are incorporated by reference as if repeated in their entirety herein.

The present invention can be used, for example, in dispensing articles that contain products such as food and beverages. These articles can include beverage containers such as cans, bottles and PET containers, as well as other containers, preferably which are substantially cylindrical or round in shape, such as those used in packaging foodstuffs. In one aspect of the present invention, a carton is provided with positioning means that can be easily positioned or oriented without the use of adhesives. In another aspect of the present invention, a carton is provided with positioning means that can be reclosed after engagement of the positioning means. In a further aspect of the present invention, a carton is provided with positioning means that does not require the user to detach and/or remove a portion of the carton.

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

Figure 1:
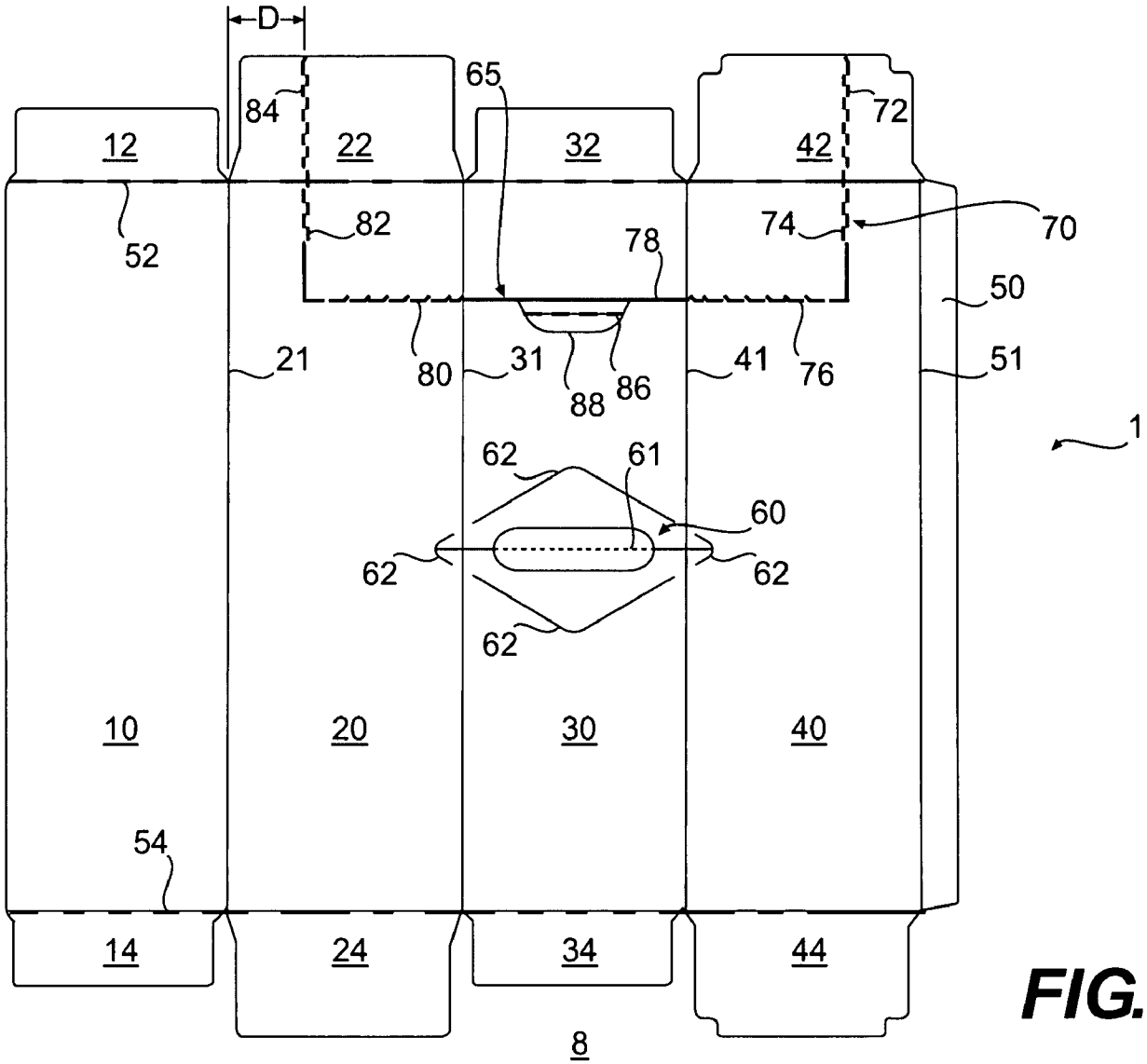
FIG. 1 is a plan view of a blank from which a carton can be formed according to the present invention.

For a more complete understanding of the present invention, reference should be made to the following detailed description and accompanying drawings, wherein like reference numerals designate corresponding parts throughout the figures.

The invention also includes a carton blank, such as a paperboard blank, which is cut to a specific shape, and creased, scored, cut, or perforated in specific areas. The carton blank defines elongate panels between the creases or fold lines, and includes flaps at the respective ends of the panels. The carton blank is folded to form a sleeve when fully assembled, so that when the end flaps are closed, the assembled carton has a front or forward end, a rearward end, and a top wall, a bottom wall, front and rear walls, and first and second side walls.

For purposes of illustration, the present invention is generally disclosed as a paperboard carton that is sized and dimensioned to contain beverages in cans. The carton illustrated in the drawing figures is sized to hold 12 articles in a 2×6 configuration, although the present invention is not limited to any specific size or dimension. For example, the present invention would work satisfactorily if sized and shaped to hold articles in a variety of other packaging configurations, such as 3×4, 4×3, 2×4, 2×5, 4×6, 4×5, 3×6, 5×6, etc. The present invention can also be used in cartons that include various unique features, including opening features that provide easy access to the articles, and tilt features that position the articles at the front end of the carton.

Also for purposes of illustration, the present invention is shown with a dispenser formed by non-oblique lines, i.e. lines that are shown as perpendicular to some panels and parallel to other panels, and by oblique lines. However, the present invention is not limited to any specific size, dimension, orientation of the dispenser, or opening formed by the dispenser. For example, the present invention would work satisfactorily if the dispenser is formed with non-oblique or oblique lines that extend through opposing panels, such as from a top panel, through side panels, and extending to the end panel.

Also for purposes of illustration, the containers shown herein generally include an end wall configuration that provide an effective barrier against at least the bottom row of cans or articles from rolling out of the carton. This end wall generally is formed to have a height that is approximately at, less than, or over $1/16^{th}$ of the height above the diameter of one can or article width high. However, depending upon the orientation and/or configuration of the carton, the end panel can be formed higher than the minimum distance required to keep the cans in the lowest row from rolling out of the container.

In FIGS. 1, 7, 14, 21, 22, and 23, example blanks that can be formed into cartons according to the principles of the present invention are shown. Each of the blanks generally are formed into a carton by folding panels/portions thereof along crease or fold lines to form a carton sleeve with a bottom flap overlapping and adhering to another bottom flap or with a top flap overlapping and adhering to another top flap. The carton blanks shown can be folded in this manner to form cartons. A securing means, such as an adhesive or compound generally is applied to secure the flaps together to form the sleeve. Once the carton is formed into a sleeve, articles, such as cans, can be placed into the sleeve and the end flaps on both ends can be closed. The end flaps typically are also held together by glue or other means.

The blank 1 shown in FIG. 1 includes bottom panel 10, side panel 20, top panel 30, side panel 40, and adhesive panel 50. The bottom panel 10 is connected to side panel 20 along a fold line 21. Side panel 20 is connected to top panel 30 at a fold line 31. Top panel 30 is connected to side panel 40 at a fold line 41. Side panel 40 is connected to adhesive panel 50 at a fold line 51. The blank 1 of FIG. 1 also is shown as including a handle 60 with crease lines 62 and an access port 61 capable of receiving a hand, fingers, or other apparatus to engage the handle to allow movement or transport of the carton as desired.

Panels 10, 20, 30, and 40 are connected to end flaps, which are separated therefrom by fold lines 52 and 54, which are substantially perpendicular to fold lines 21, 31, 41, and 51. The end flaps extend along a first marginal area 8 of the blank 1. Specifically, bottom panel 10 is connected along fold line 52 to a bottom panel end flap 12 and connected along a fold line 54 to a bottom panel end flap 14. Side panel 20 is connected along fold line 52 to side panel end flap 22 and is connected to side panel end flap 24 along fold line 54. Top panel 30 is connected to top panel end flap 32 along fold line 52 and is connected to top panel end flap 34 along fold line 54. Side panel 40 is connected to side panel end flap 42 along fold line 52 and is connected to side panel end flap 44 along fold line 54.

A tear line 65 is shown in blank 1 of FIG. 1 and extends through side panel end flaps 22 and 42, side panels 20 and 40, and top panel 30. When the carton is formed, the tear line is separable so as to create a detachable portion 70 (FIGS. 2-4) that is openable to create an opening in the enclosed carton that allows removal of the containers enclosed therein. The detachable portion can remain hingedly attached or can be entirely removed from the carton. Along the tear line and formed in the top panel 30 is an access opening 86 formed along the tear line in the top panel and defining a perimeter opening at 88.

Generally the tear line 65 (FIG. 1) includes a series of sections or portions and extends across the top panel at 78 into each side panel a specified distance, in side panel 20 along tear line 80 and in side panel 40 along tear line 76. Generally, the tear line extends at a non-oblique angle for each of the side panels, extending substantially perpendicular, or at an approximately ninety-degree (90°) angle to the top panel, with the tear line proceeding through the side panels, into, and through the respective side panel end flaps. Accordingly, the tear line 76 intersects with tear line 74 formed in side panel 40 to intersect with fold line 52 and extend into side panel end flap 42 along a tear line 72 to an outer periphery thereof. Similarly, a tear line 80 extends through side panel 20 to tear line 82, also formed in side panel 20 and which extends to fold line 52 and into side panel end flap 22 along a tear line 84 to an outer periphery thereof.

The tear line generally extends in each side panel 20 and 40 a distance capable of forming the detachable portion while still retaining a bottom end container in the enclosed carton when the opening is created. This distance D shown in the figures generally can be in the range of 30-200% of the diameter of the can in the side panels 20, 40, and can extend from a support surface SS upon which the enclosed carton is resting to retain the bottom row container in the enclosed carton. Distance D can be any distance measured from fold line 21 to and including fold line 31. Thus, this distance or height of the tear line into each side panel can be greater than or less than a diameter of a container in the enclosed carton or can be a percentage of the diameter of the carton capable of retaining the container in the enclosed carton. For example, this height can be 5%, 10%, 20%, 30%, 40%, 50%, 55%, 65%, 75%, 85%, 95%, or any increment or range of these percentages. Further, the percentage or range can be greater than the diameter of a container C, for example, 105-200% of the diameter of a container in the bottom row. If the carton is formed to enclose more than two rows of containers, such as three or four rows, the height of the tear line in each side panel can be greater or lesser than these percentages.

Figure 2:
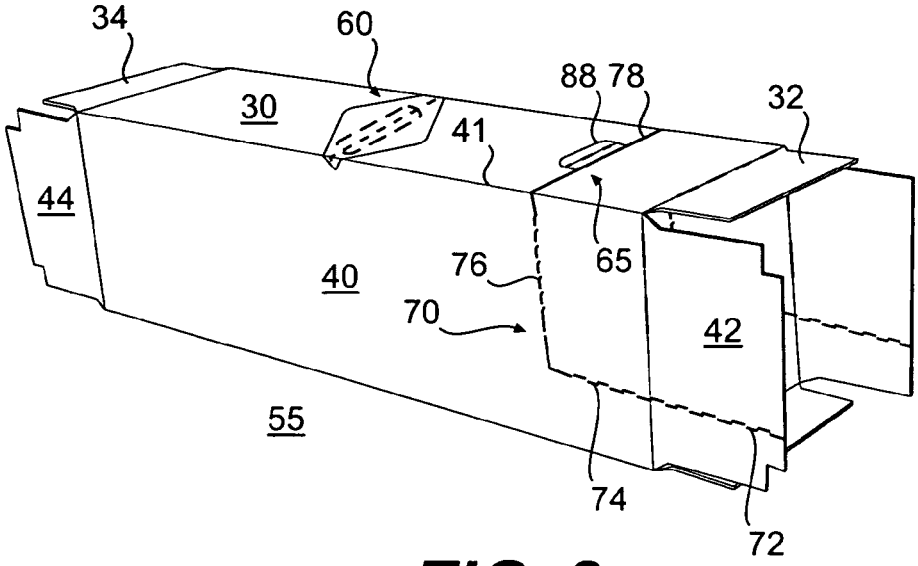
FIG. 2 is a perspective view of a sleeve formed from the blank of FIG. 1.

FIG. 2 shows a sleeve formed of the blank of FIG. 1. Generally, the sleeve is formed by applying adhesive to an adhesive flap, such as adhesive panel 50 and securing the adhesive panel 50 to bottom panel 10. The blank 1 shown in FIG. 1 can be formed in a different configuration to provide, for example, a five panel blank with two folding panels that become the bottom or top panel when adhesively secured together.

Figure 3:
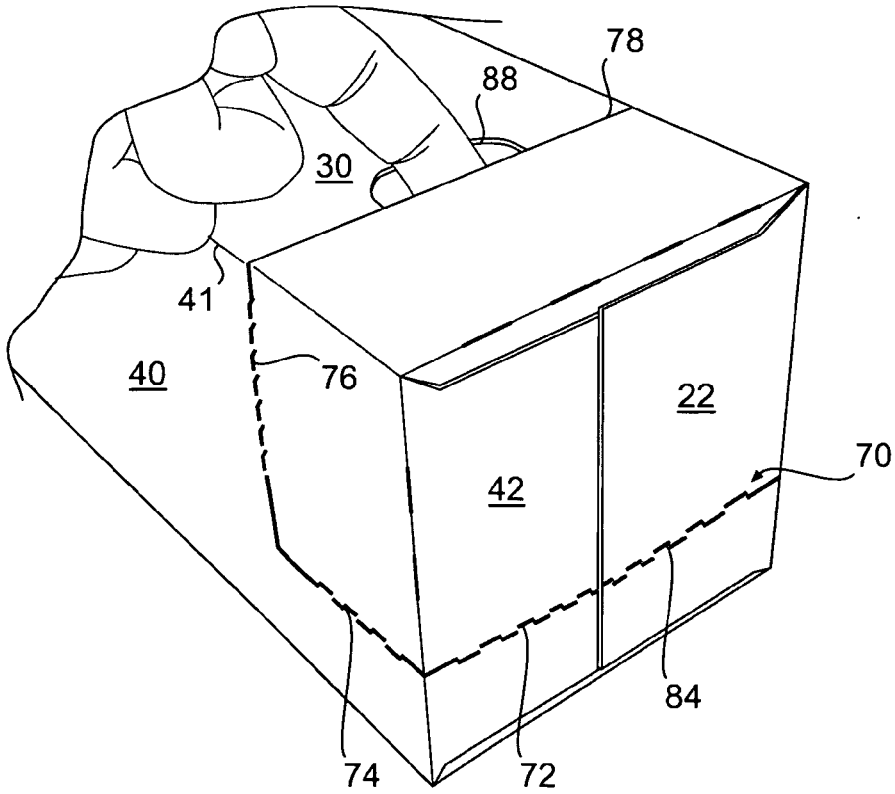
FIG. 3 is a perspective view of an exiting end of an enclosed carton formed from the sleeve of FIG. 2 with the access port engaged.

FIG. 3 shows the sleeve of FIG. 2 with the end panel flaps being closed and adhesively secured to secure containers in the enclosed carton. These containers generally are forced or otherwise placed into the sleeve of FIG. 2 and the end panel flaps are closed to secure and create two ends of an enclosed carton, such as that shown in FIG. 3. Also shown in FIG. 3, an access opening for the finger flap 86 or other access feature for the resultant carton generally is created along perimeter 88 to allow a user to more easily separate along the tear line the detachable portion of the exiting end of the carton to create the opening.

Figure 4:
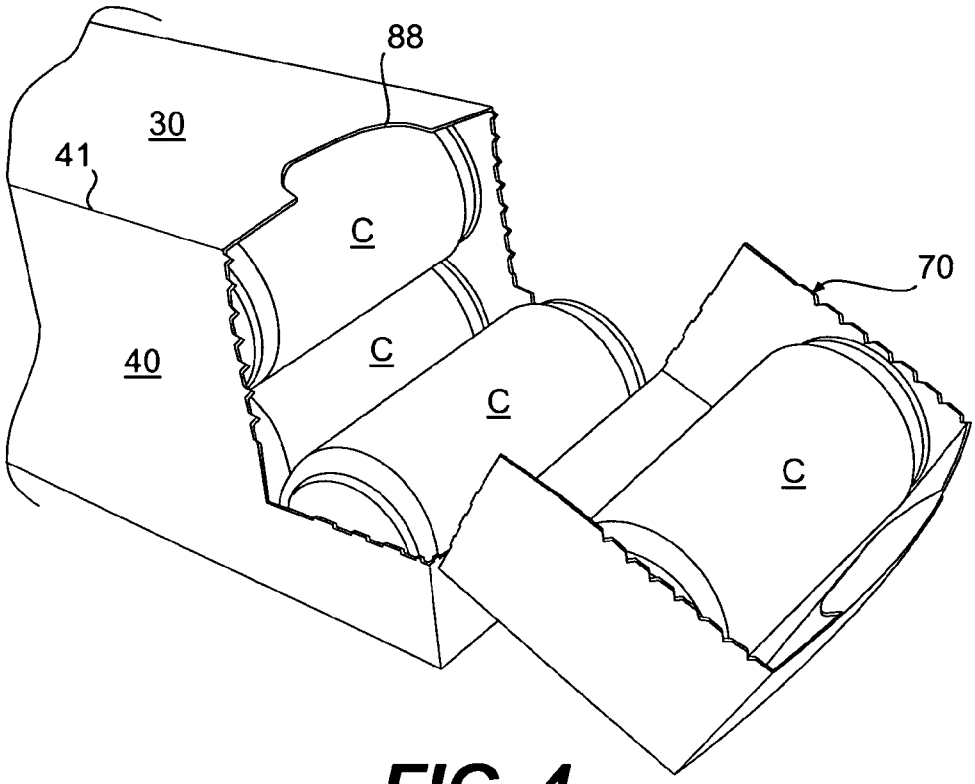
FIG. 4 is a perspective view of the carton of FIG. 3 with an opening created by detachment along the tear line.

FIG. 4 shows the detachable portion 70 being hingedly detached along the tear line to create an opening to allow removal of containers C from the carton. As shown in FIG. 4, the detachable portion can remain hinged along a tear line formed in the exiting end and is capable of dispensing a container C, such as from the top row adjacent the exiting end.

Figure 5:
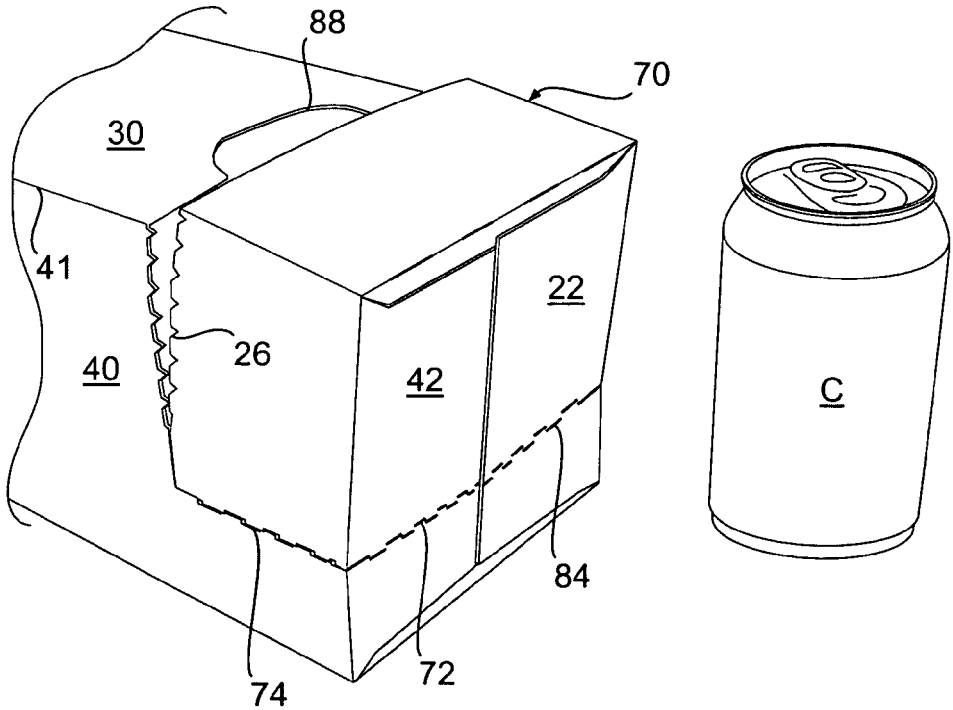
FIG. 5 shows the opening feature hinged to reclose the carton of FIG. 3.
Figure 6:
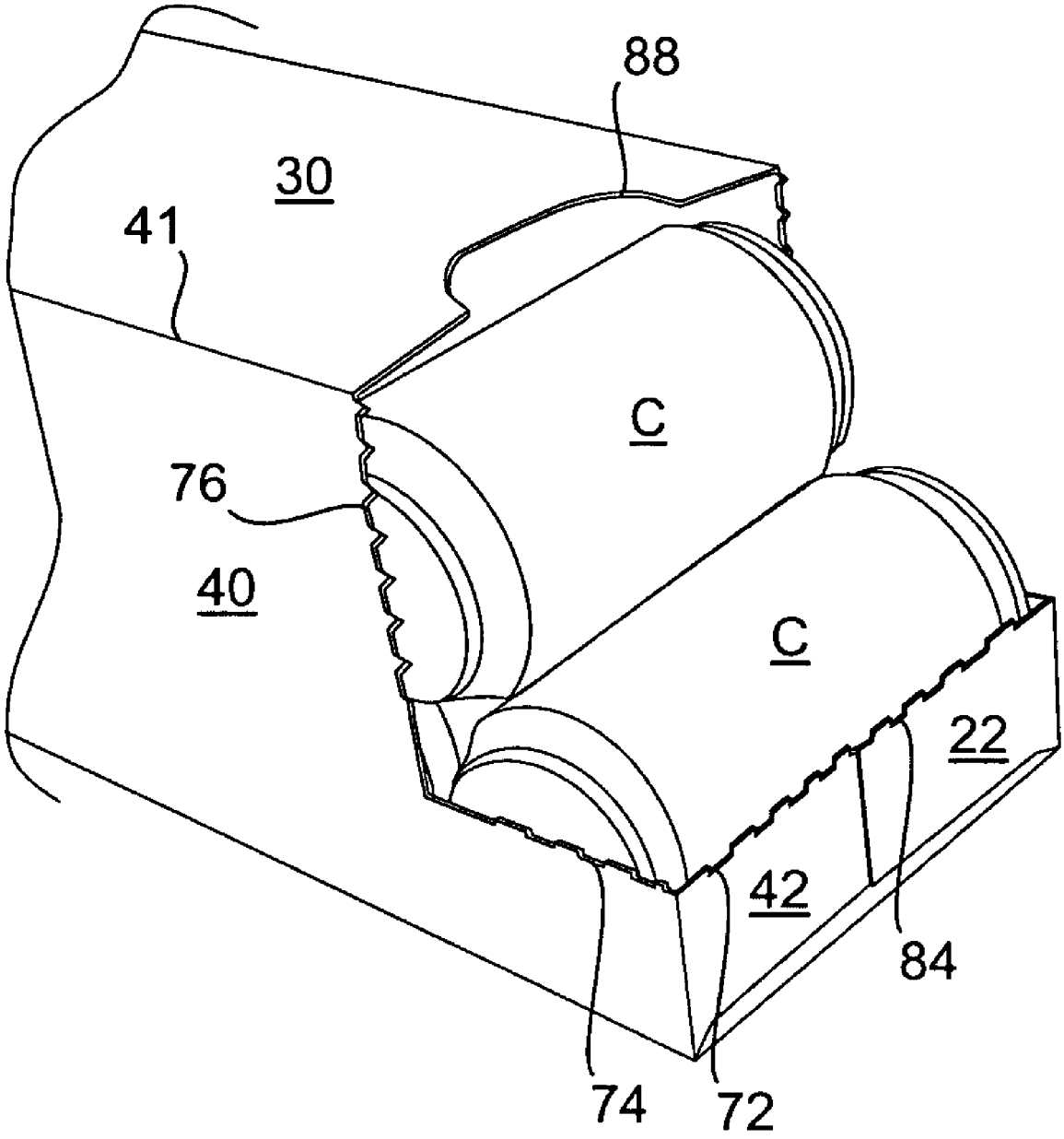
FIG. 6 shows the opening feature being disengaged from the enclosed carton.

As shown in FIG. 5, the detachable portion can be hinged to reclose the carton after the detachable portion is created along the tear line. FIG. 6 shows the detachable portion being detached along the tear line at the exiting end to be entirely removed from the carton.

Figure 7:
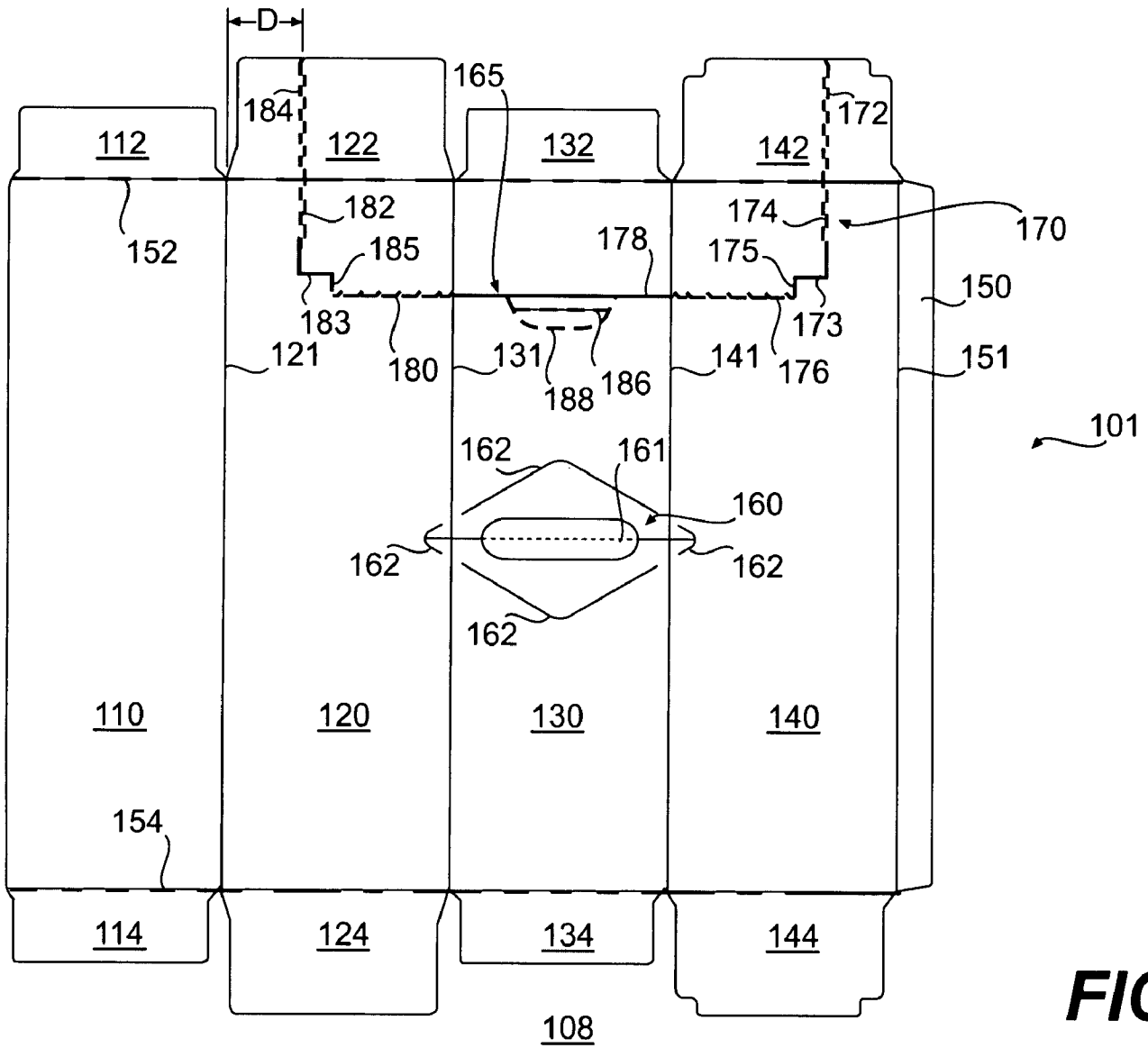
FIG. 7 is a plan view of an alternate blank from which a carton can be formed according to the present invention.

The blank 101 shown in FIG. 7 includes bottom panel 110, side panel 120, top panel 130, side panel 140, and adhesive panel 150. The bottom panel 110 is connected to side panel 120 along a fold line 121. Side panel 120 is connected to top panel 130 at a fold line 131. Top panel 130 is connected to side panel 140 at a fold line 141. Side panel 140 is connected to adhesive panel 150 at a fold line 151. The blank 101 of FIG. 7 is also shown as including a handle 160 with crease lines 162 and an access port 161 capable of receiving a hand, fingers, or other apparatus to engage the handle to allow movement or transport of the carton as desired.

Panels 110, 120, 130, and 140 are connected to end flaps, which are separated therefrom by fold lines 152 and 154, which are arranged substantially perpendicular to fold lines 121, 131, 141, and 151. The end flaps extend along a first marginal area 108 of the blank 101. Specifically, bottom panel 110 is connected along fold line 152 to a bottom panel end flap 112 and connected along a fold line 154 to a bottom panel end flap 114. Side panel 120 is connected along fold line 152 to side panel end flap 122 and is connected to side panel end flap 124 along fold line 154. Top panel 130 is connected to top panel end flap 132 along fold line 152 and is connected to top panel end flap 134 along fold line 154. Side panel 140 is connected to side panel end flap 142 along fold line 152 and is connected to side panel end flap 144 along fold line 154.

A tear line 165 is shown in blank 101 of FIG. 7 that extends through side panel end flaps 122 and 142, side panels 120 and 140, and top panel 130. When the carton is formed, the tear line can create a detachable portion 170 to create an opening in the enclosed carton that allows removal of the containers enclosed therein. An access opening 186 formed along the tear line in the top panel 130 and defines a perimeter opening indicated at 188.

Generally, the tear line extends in the top panel at 178 into each side panel a specified or desired distance, extending through side panel 120 along tear line 180 and through side panel 140 along tear line 176. Generally, the tear line extends at a non-oblique angle for each of the side panels extending substantially perpendicular, or at an approximately ninety-degree (90°) angle to the top panel, with the tear line proceeding through the side panels, into, and through the respective side panel end flaps. Tear line 176 extends a distance into the side panel 140 to a first step portion to turn at approximately 90° to extend a first step run distance 175 then turn at approximately 90° to extend a first step rise distance 173 then turn at approximately 90° to extend along tear line 174 to intersect with fold line 152 and extend into side panel end flap 142 along a tear line 172 to an outer periphery thereof. Similarly, a tear line 180 extends through side panel 120 to a first step portion to turn at approximately 90° to extend a first step run distance 185 then turn at approximately 90° to extend a first step rise distance 183 then turn at approximately 90° to extend along tear line 182 to intersect with fold line 152 and into side panel end flap 122 along tear line 184 to an outer periphery thereof.

Generally, the stair included in the blank 101 of FIG. 7 assists a user during removal of the detachable portion 170 to create the opening in an enclosed carton. The stair portion can alleviate the forces existent in detachable portions without a stair by creating areas of incremental tear line detachment, requiring lower, incremental forces, to detach the detachable portion to create the opening in the enclosed carton.

Figure 8:
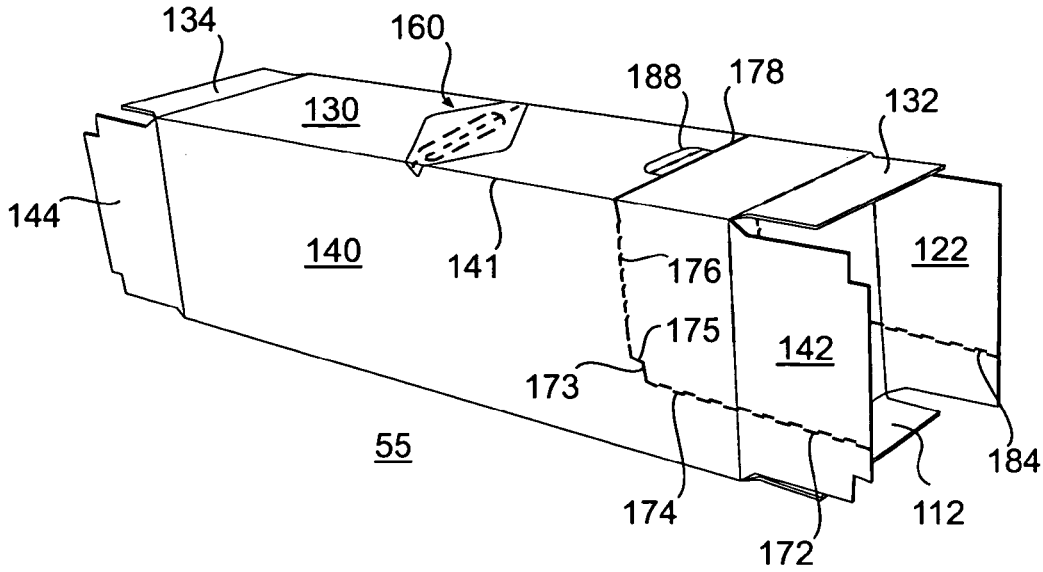
FIG. 8 shows a perspective view of a sleeve formed from the blank of FIG. 7.

FIG. 8 shows a sleeve formed of the blank of FIG. 7. Generally, the sleeve is formed by applying adhesive to an adhesive flap, such as adhesive panel 150 and securing the adhesive panel 150 to bottom panel 110. The blank 101 shown in FIG. 7 can be formed in a different configuration to, for example, provide a five panel blank with two folding panels that become the bottom panel and which are adhesively secured thereto each other.

Figure 9:
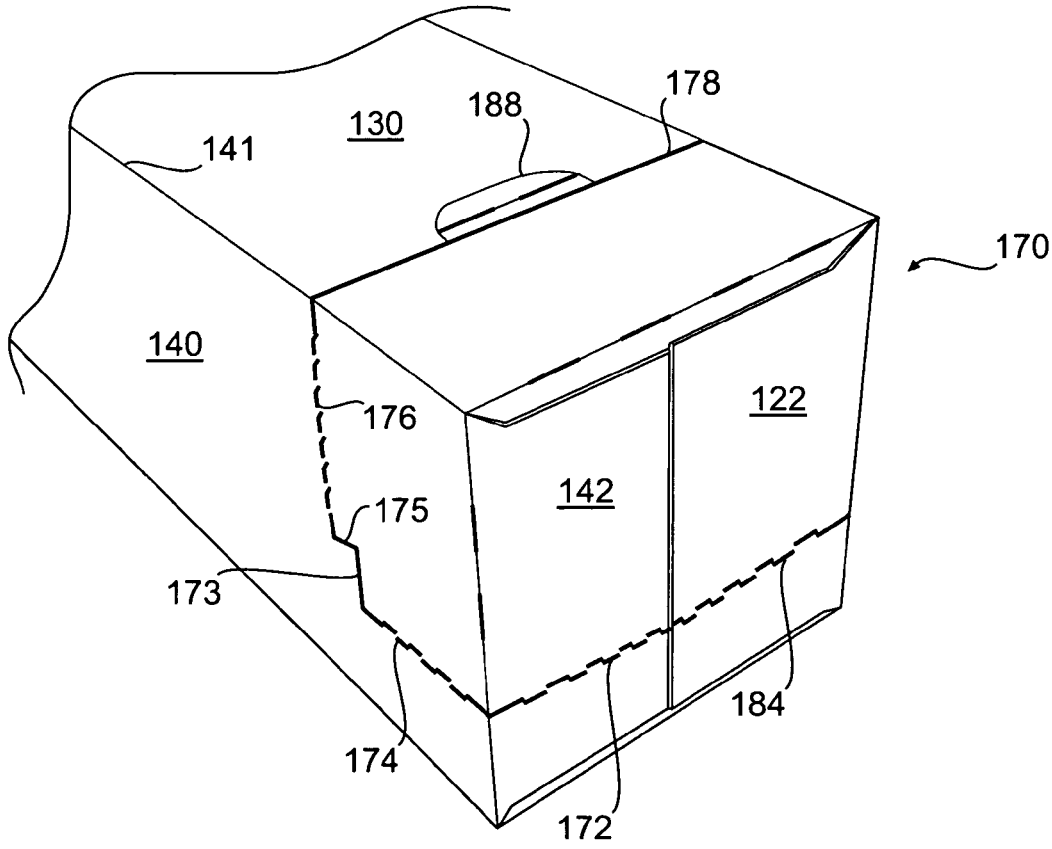
FIG. 9 shows an exiting end of a carton formed from the sleeve of FIG. 8.
Figure 10:
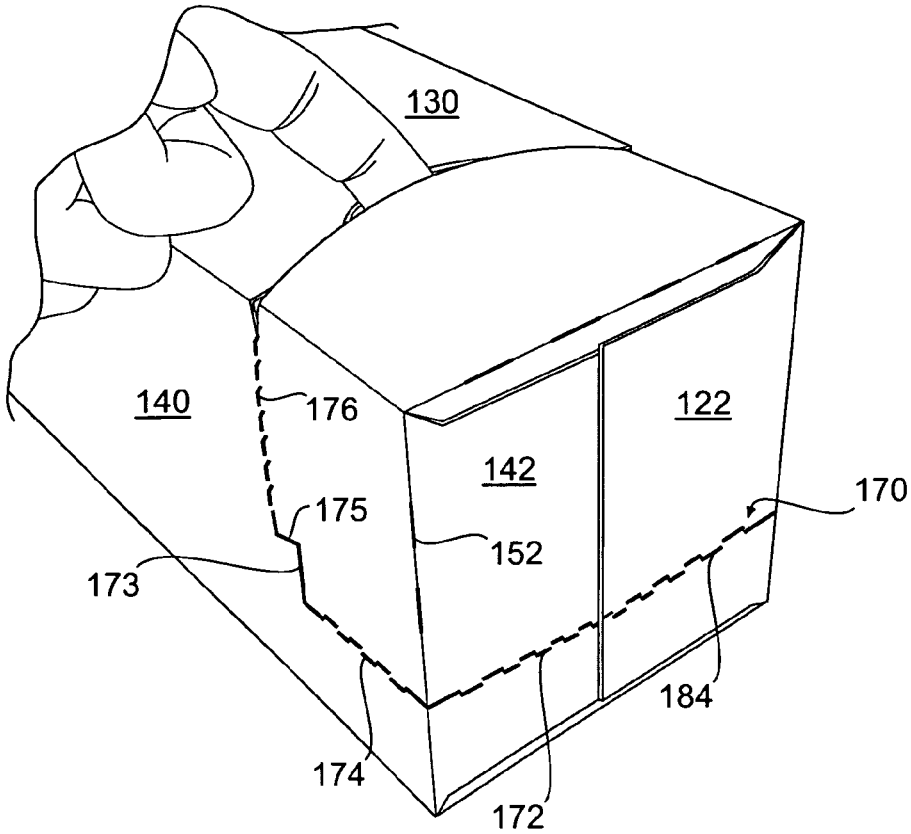
FIG. 10 shows the access feature being engaged in the carton of FIG. 9.

FIG. 9 shows the sleeve of FIG. 8 with the end panel flaps being closed and adhesively secured to secure containers in the enclosed carton. These containers generally are inserted into the sleeve of FIG. 8 and the end panel flaps are closed to secure and create two ends of an enclosed carton. FIG. 10 shows engagement of the access opening by a user's finger. The access opening for the finger flap 186 or other access feature for the resultant carton generally is created along perimeter 188 to allow a user to more easily separate along the tear line the detachable portion of the exiting end of the carton to create an opening thereof for removal of containers C from the enclosed carton.

Figure 11:
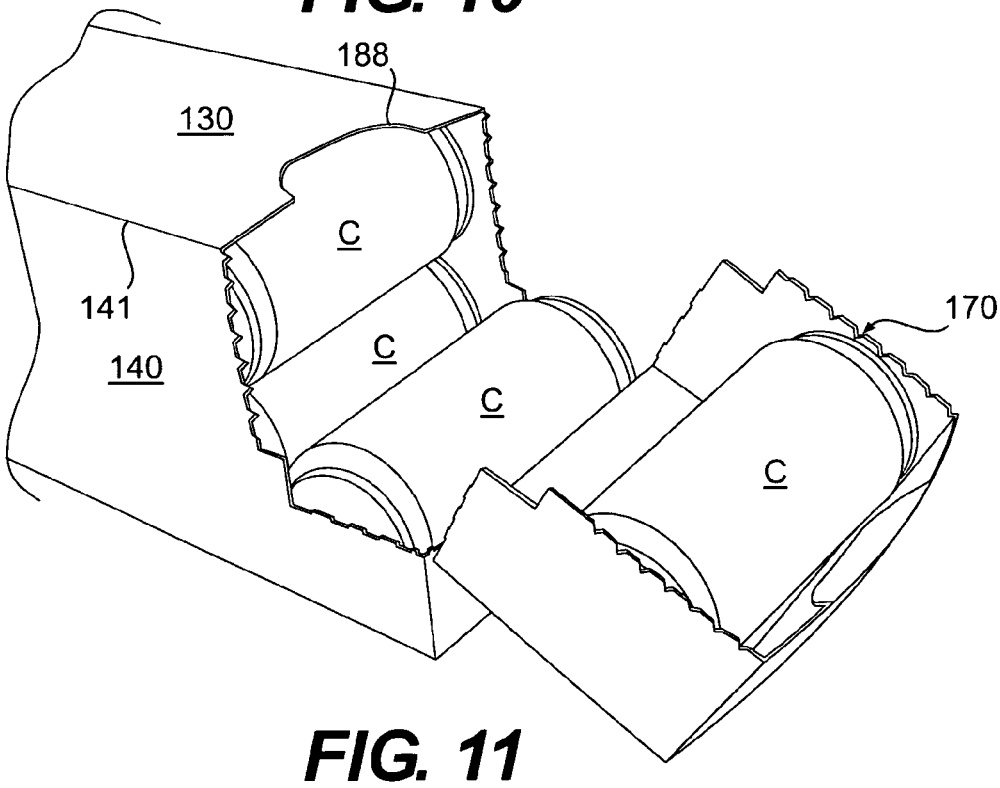
FIG. 11 shows the opening feature of the carton being hingedly disengaged from the carton.

FIG. 11 shows the detachable portion 170 being hingedly detached along the tear line to create an opening to allow removal of containers C from the carton. As shown in FIG. 11, the detachable portion can remain hinged along a tear line formed in the exiting end and can receive a container C, from the top row adjacent the existing end in the opening feature of the detachable portion.

Figure 12:
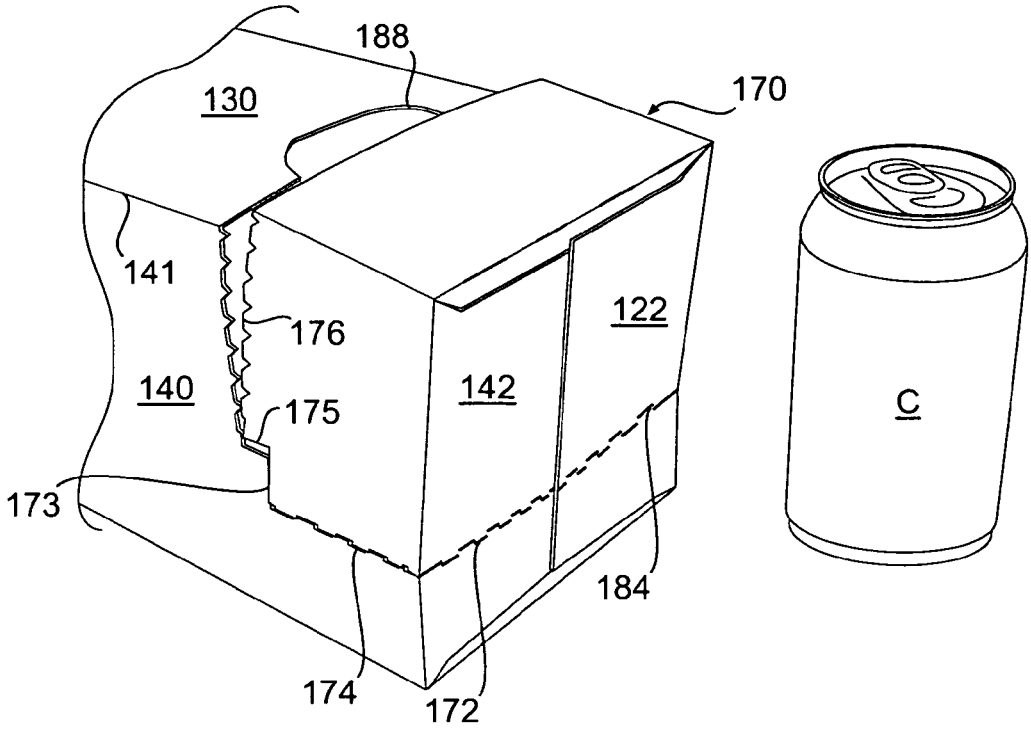
FIG. 12 shows the opening feature of the carton being reclosed after a container has been removed therefrom.
Figure 13:
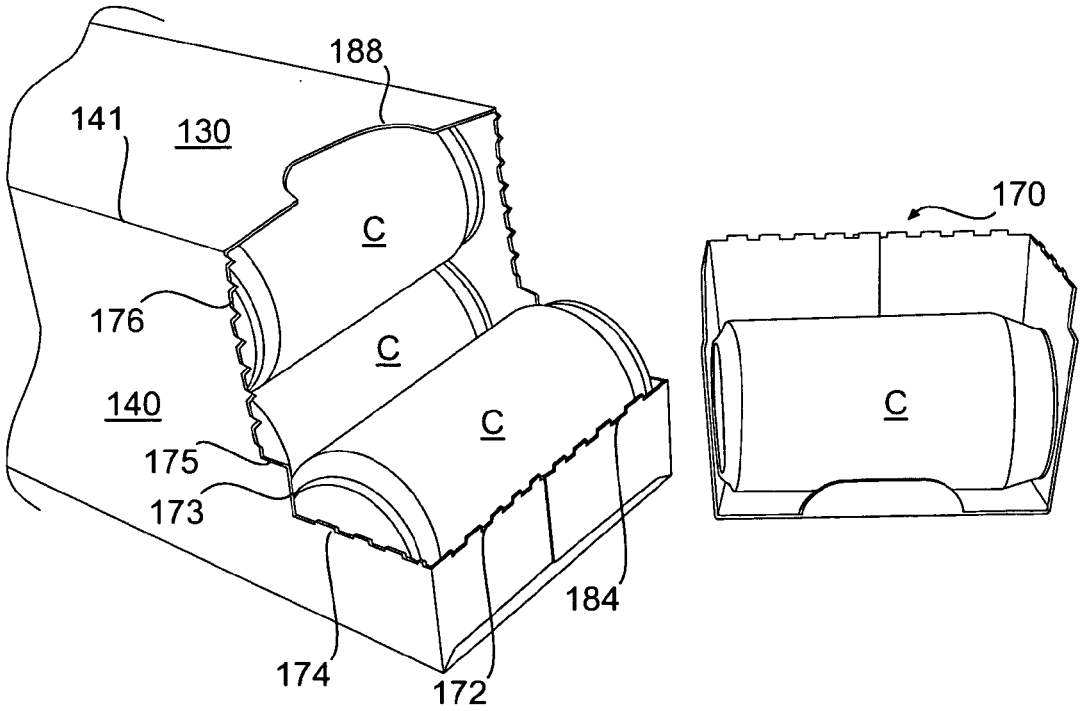
FIG. 13 shows the opening feature being entirely removed from the carton.

As shown in FIG. 12, the detachable portion 170 can be hingedly reclosed to enclose the remaining containers in the enclosed carton after containers have been removed therefrom. FIG. 13 shows the detachable portion being detached along the tear line at the exiting end to create the opening and allow detachment of the detachable portion from the enclosed carton.

Figure 14:
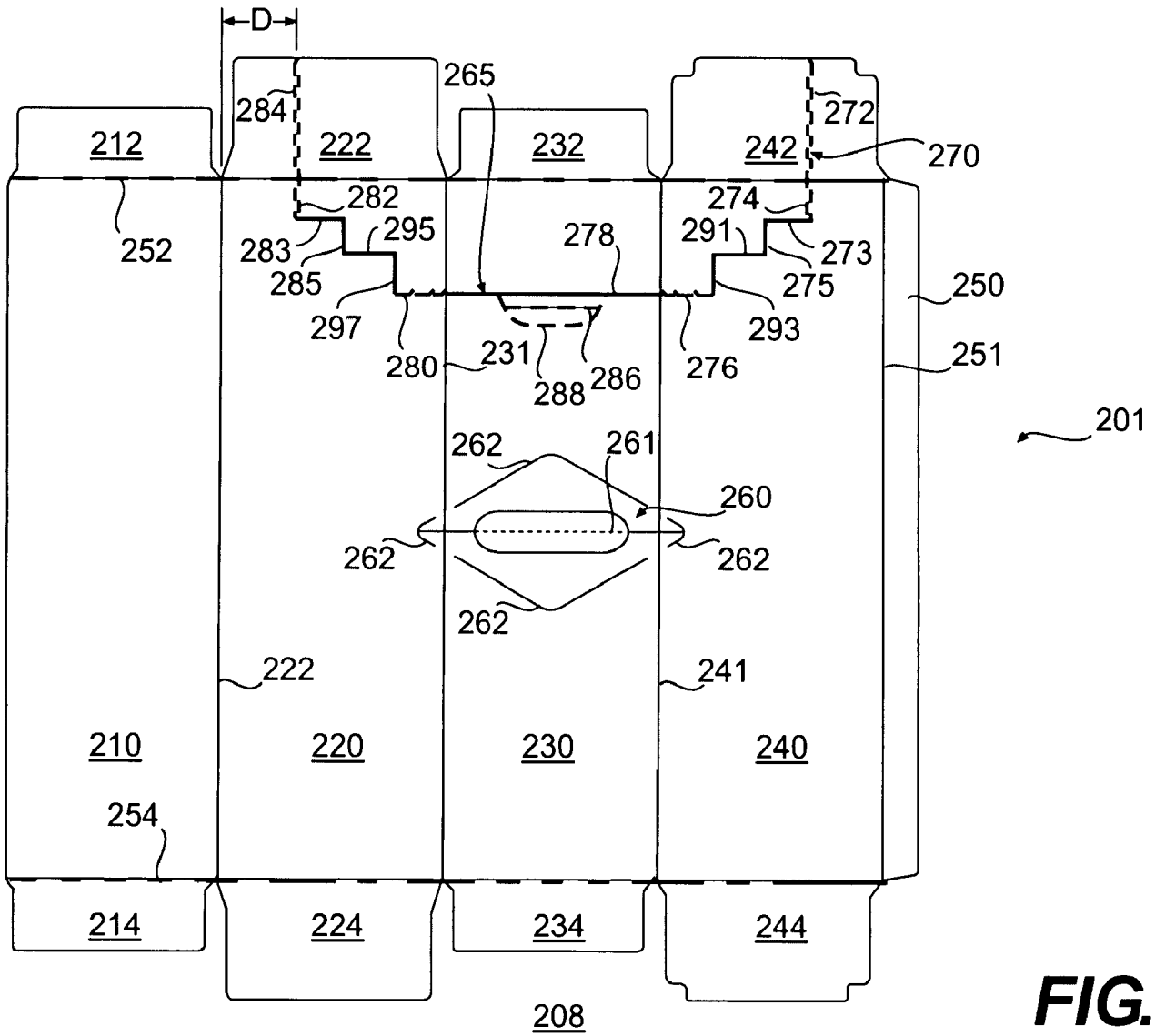
FIG. 14 is a plan view of an alternate blank from which a carton can be formed according to the present invention.

The blank 201 shown in FIG. 14 includes bottom panel 210, side panel 220, top panel 230, side panel 240, and adhesive panel 250. The bottom panel 210 is connected to side panel 220 along a fold line 221. Side panel 220 is connected to top panel 230 at a fold line 231. Top panel 230 is connected to side panel 240 at a fold line 241. Side panel 240 is connected to adhesive panel 250 at a fold line 251. The blank 201 of FIG. 14 also is shown as including a handle 260 with crease lines 262 and an access port 261 capable of receiving a hand, fingers, or other apparatus to engage the handle to allow movement or transport of the carton as desired.

Panels 210, 220, 230, and 240 are connected to end flaps, which are separated therefrom by fold lines 252 and 254, which are substantially perpendicular to fold lines 221, 231, 241, and 251. The end flaps extend along a first marginal area 208 of the blank 201. Specifically, bottom panel 210 is connected along fold line 252 to a bottom panel end flap 212 and connected along a fold line 254 to a bottom panel end flap 214. Side panel 220 is connected along fold line 252 to side panel end flap 222 and is connected to side panel end flap 224 along fold line 254. Top panel 230 is connected to top panel end flap 232 along fold line 252 and is connected to top panel end flap 234 along fold line 254. Side panel 240 is connected to side panel end flap 242 along fold line 252 and is connected to side panel end flap 244 along fold line 254.

A tear line 265 is shown in blank 201 of FIG. 14 and extends through side panel end flaps 222 and 242, side panels 220 and 240, and top panel 230. When the carton is formed, the tear line is separable so as to create a detachable portion 270 that is openable to create an opening in the enclosed carton that allows removal of the containers enclosed therein. Along the tear line and formed in the top panel 230 is an access opening 286 formed along the tear line in the top panel and defining a perimeter opening at 288.

Generally the tear line includes a series of sections or portions and extends across the top panel at 278 into each side panel a specified distance, in side panel 220 along tear line 280 and in side panel 240 along tear line 276. Generally, the tear line extends at a non-oblique angle for each of the side panels, extending substantially perpendicular, or at an approximately ninety-degree (90°) angle to the top panel, with the tear line proceeding through the side panels, into, and through the respective side panel end flaps. Tear line 276 extends a distance into the side panel 240 to a first step portion to turn at approximately 90° to extend a first step run distance 293 then turn at approximately 90° to extend a first step rise distance 291 then turn at approximately 90° to extend a second step run distance 275 to then turn at approximately 90° and extend a second step rise distance 273 to turn at approximately 90° and to extend along tear line 274 to intersect with fold line 252 and extend into side panel end flap 242 along a tear line 272 to an outer periphery thereof. Similarly, a tear line 180 extends through side panel 220 to a first step portion to turn at approximately 90° to extend a first step run distance 297 then turn at approximately 90° to extend a first step rise distance 295 then turn at approximately 90° to extend a second step run distance 285 to then turn at approximately 90° and extend a second step rise distance 283 to turn at approximately 90° and extend into and through the side panel end flaps to extend along tear line 282 to intersect with fold line 252 and into side panel end flap 222 along tear line 284 to an outer periphery thereof.

A detachable portion 270 is formed by removal at the finger flap 288 formed in the top panel and detaching the detachable portion to create an opening in the enclosed carton. The detachable portion can remain hingedly attached to, or can be entirely removed from, the formed carton.

Generally, the stairs included in the blank 201 of FIG. 14 assist a user during removal of the detachable portion 270 to create the opening in an enclosed carton. The stair portions can alleviate the forces existent in detachable portions without stairs by creating areas of incremental tear line detachment, requiring lower, incremental forces, to detach the detachable portion to create the opening in the enclosed carton.

Figure 15:
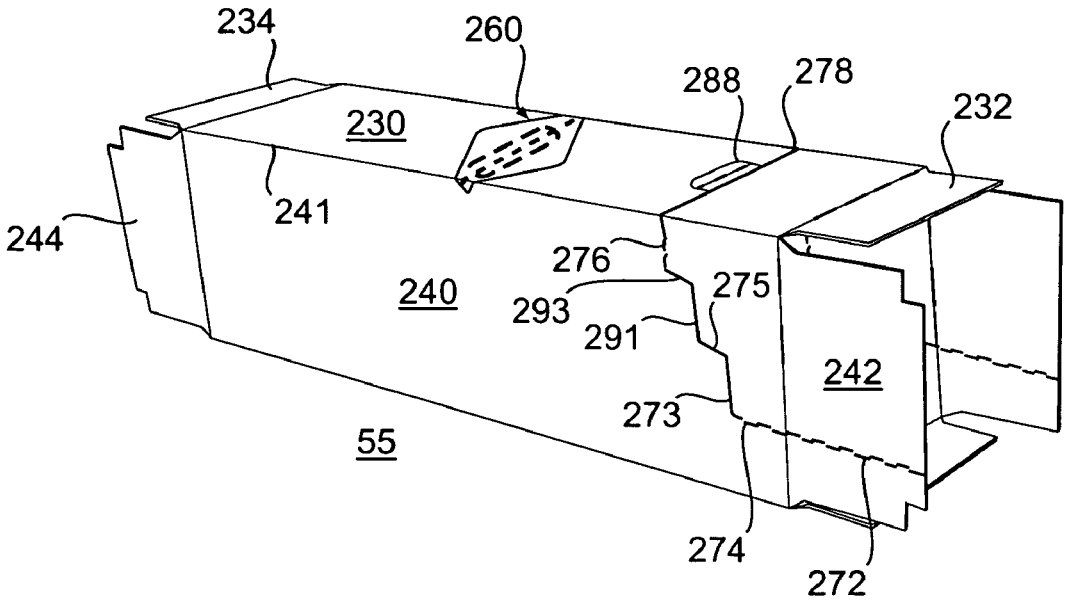
FIG. 15 is a perspective view of the sleeve formed from the blank of FIG. 14.

FIG. 15 shows a sleeve formed of the blank of FIG. 14. Generally, the sleeve is formed by applying adhesive to an adhesive flap, such as adhesive panel 250 and securing the adhesive panel 250 to bottom panel 210. The blank 201 shown in FIG. 14 can be formed in a different configuration to, for example, provide a five panel blank with two folding panels that become the bottom panel and which are adhesively secured thereto each other.

Figure 16:
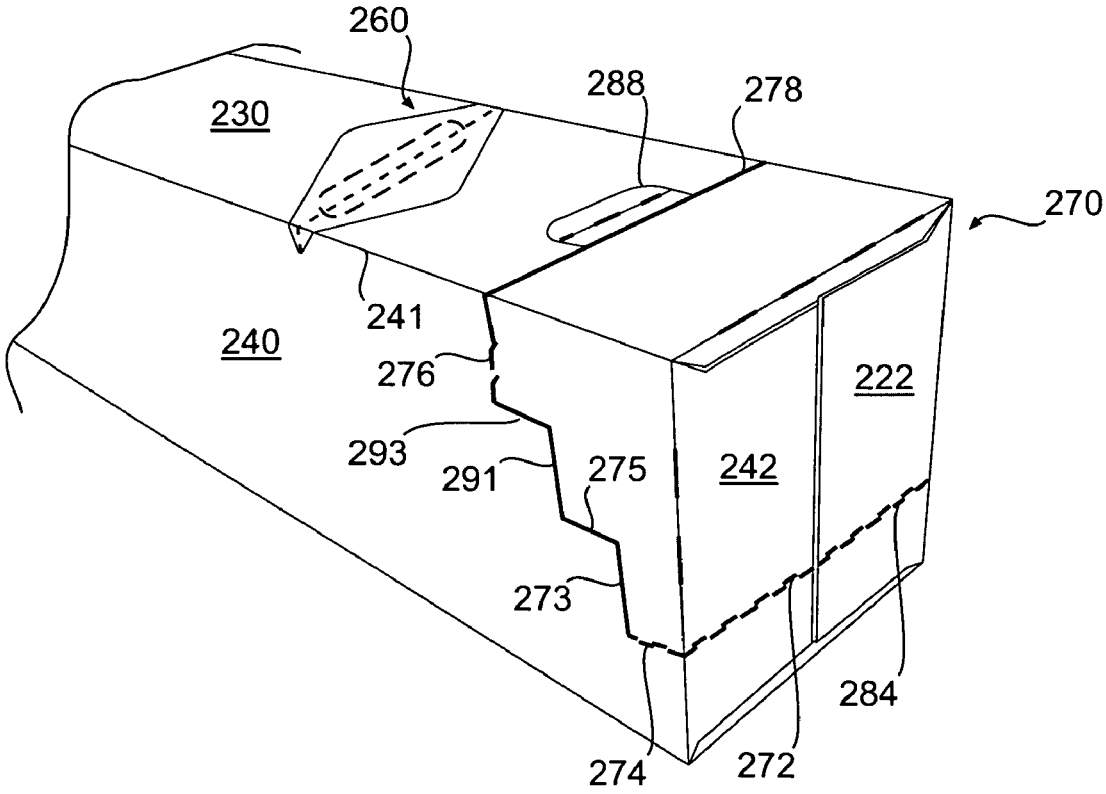
FIG. 16 shows an enclosed carton formed from the sleeve of FIG. 15.
Figure 17:
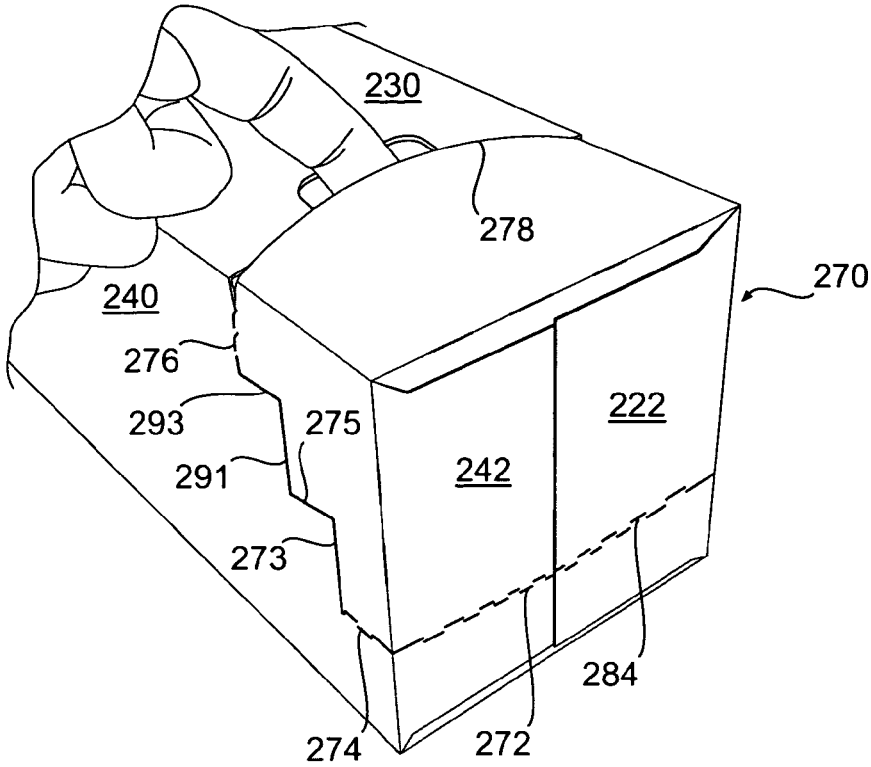
FIG. 17 shows the access port being engaged.

FIG. 16 shows the sleeve of FIG. 15 with the end panel flaps being closed and adhesively secured to secure containers in the enclosed carton. These containers generally are inserted into the sleeve of FIG. 15 and the end panel flaps are closed to secure and create two ends of an enclosed carton. FIG. 17 shows engagement of the access opening by a user's finger. The access opening for the finger flap is created along perimeter 288 to allow a user to more easily separate along the tear line the detachable portion of the exiting end of the carton to create an opening thereof for removal of containers C from the enclosed carton.

Figure 18:
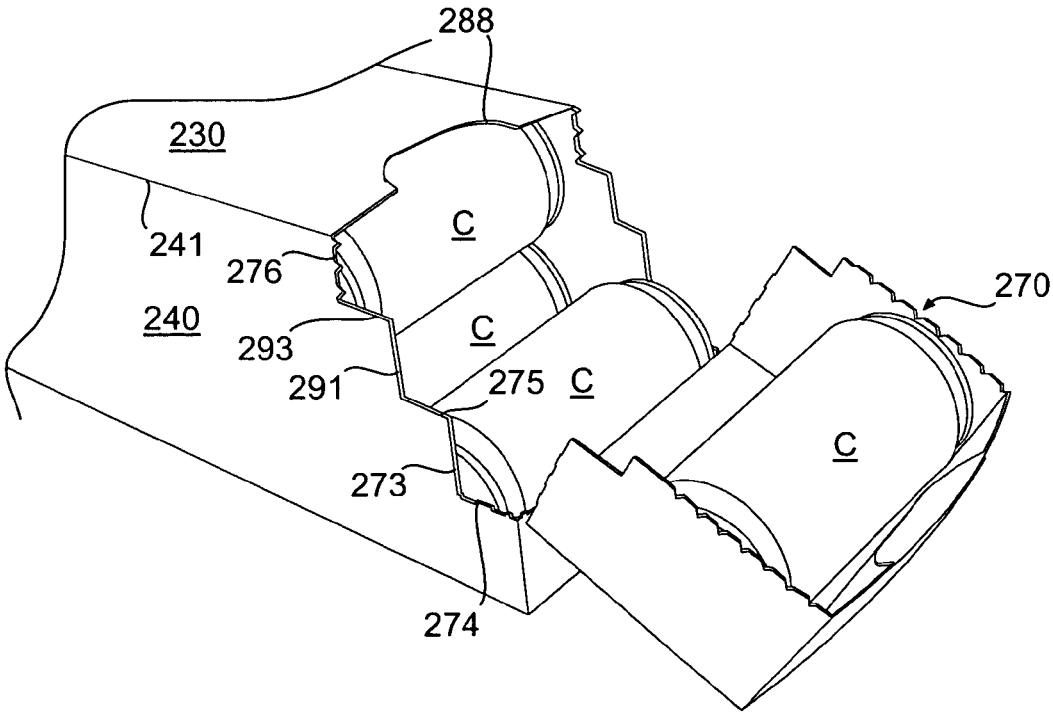
FIG. 18 shows the opening feature being engaged and removed along the tear lines to remain hingedly attached to the carton.

FIG. 18 shows the detachable portion being hingedly detached along the tear line to create an opening to allow removal of containers C from the carton. As shown in FIG. 18, the detachable portion can remain hinged along a tear line formed in the exiting end and can receive a container C, from the top row adjacent the existing end in the opening feature of the detachable portion.

Figure 19:
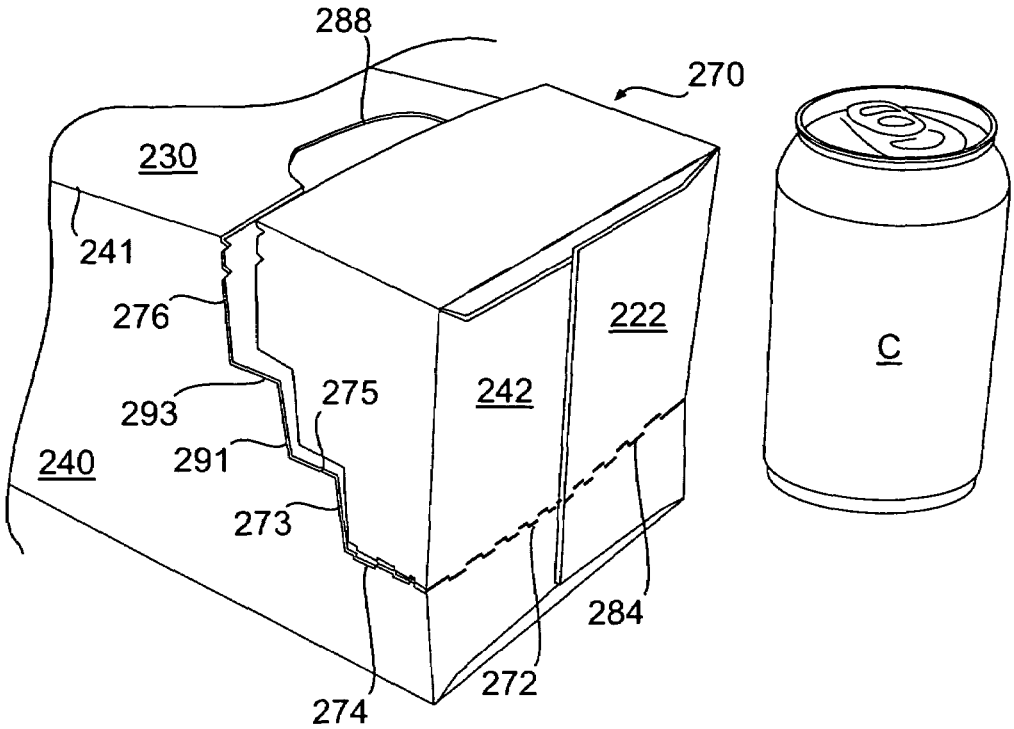
FIG. 19 shows the opening feature being reclosed.
Figure 20:
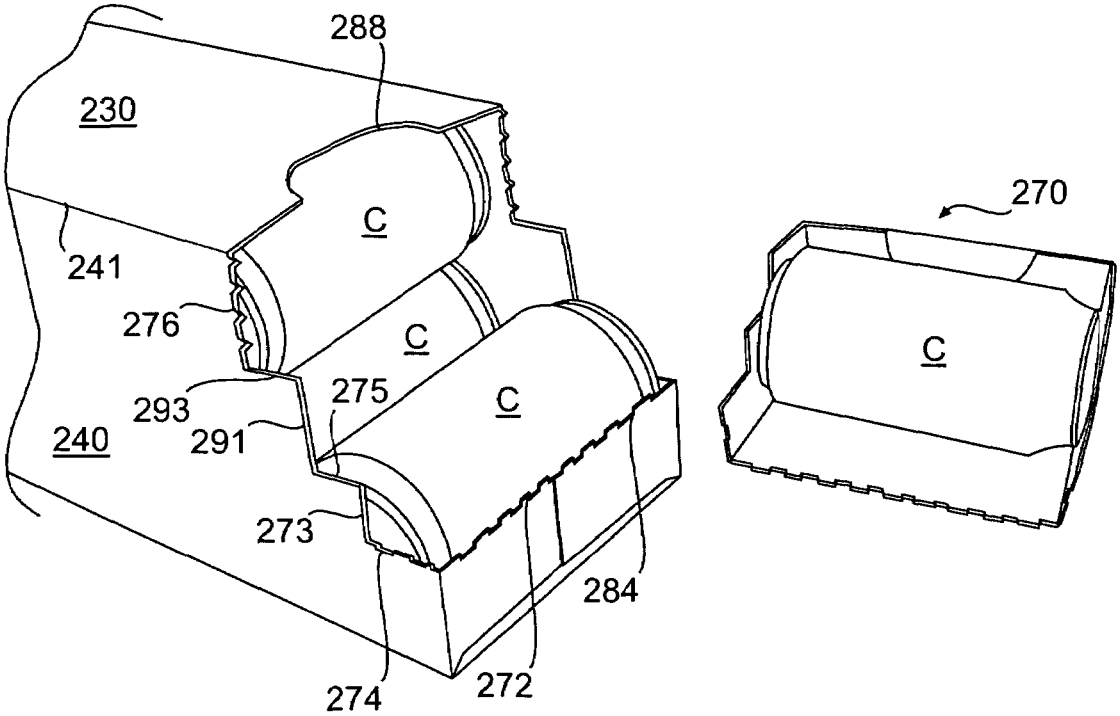
FIG. 20 shows the opening feature being entirely disengaged from the carton along the tear line.

As shown in FIG. 19, the detachable portion can be hingedly reclosed to enclose the remaining containers in the enclosed carton after containers have been removed therefrom. FIG. 20 shows the detachable portion being detached along the tear line at the exiting end to create the opening and allow detachment of the detachable portion from the enclosed carton.

Figure 21:
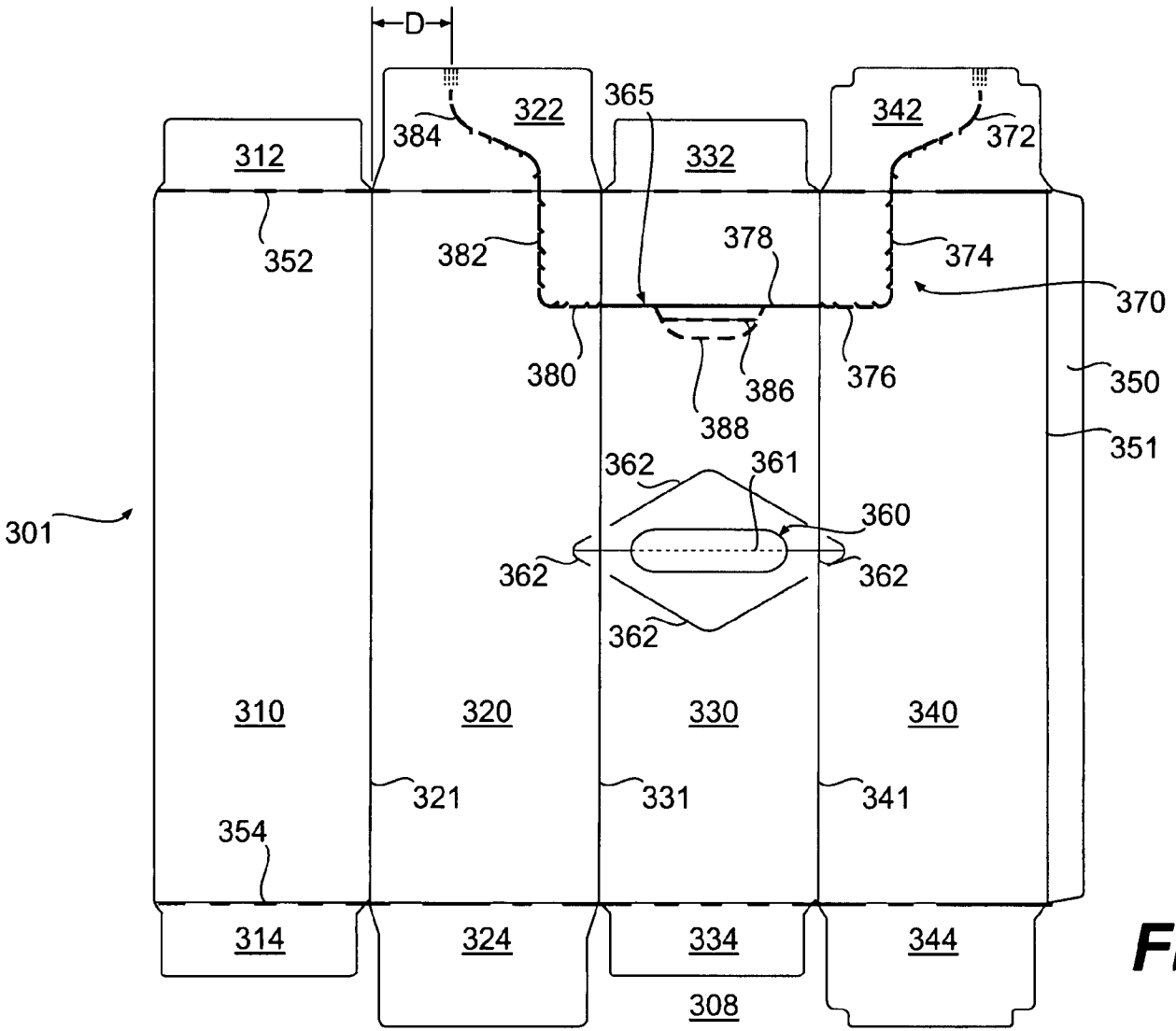
FIG. 21 is a plan view of another alternate blank from which a carton can be formed according to the present invention.

The blank shown in FIG. 21 is analogous to the blanks shown in FIGS. 1, 7, and 14, with an alternate tear line orientation formed in the side panel end flaps. As shown in FIG. 21, the tear line extends from the finger flap 386 in the top panel along perimeter 388 into each side panel in a direction substantially perpendicular to the top panel to an approximately ninety-degree (90°) angle turn. The tear line then extends into each side panel end flap a distance to an oblique angle to extend a distance and turn to extend to a periphery portion of the side panel end flaps. The depth D of the cut in the side panel end flaps can be varied as desired, and generally includes the substantially similar ranges as provided above.

The blank 301 shown in FIG. 21 includes bottom panel 310, side panel 320, top panel 330, side panel 340, and adhesive panel 350. The bottom panel 310 is connected to side panel 320 along a fold line 321. Side panel 320 is connected to top panel 330 at a fold line 331. Top panel 330 is connected to side panel 340 at a fold line 341. Side panel 340 is connected to adhesive panel 350 at a fold line 351. The blank 301 of FIG. 21 also is shown as including a handle 360 with crease lines 362 and an access port 361 capable of receiving a hand, fingers, or other apparatus to engage the handle to allow movement or transport of the carton as desired.

Panels 310, 320, 330, and 340 are connected to end flaps, which are separated therefrom by fold lines 352 and 354, which are substantially perpendicular to fold lines 321, 331, 341, and 351. The end flaps extend along a first marginal area 308 of the blank 301. Specifically, bottom panel 310 is connected along fold line 352 to a bottom panel end flap 312 and connected along a fold line 354 to a bottom panel end flap 314. Side panel 320 is connected along fold line 352 to side panel end flap 322 and is connected to side panel end flap 324 along fold line 354. Top panel 330 is connected to top panel end flap 332 along fold line 352 and is connected to top panel end flap 334 along fold line 354. Side panel 340 is connected to side panel end flap 342 along fold line 352 and is connected to side panel end flap 344 along fold line 354.

The tear lines 365 shown in FIG. 21 extend from the top panel 330 along tear line 378 into the side panels through fold lines 331 and 341. In side panel 320, the tear line extends to the perpendicular angle at 380 to turn and extend along tear line 382 across fold line 352 into side panel end flap 322 to extend along tear line 384. In side panel 340, the tear line extends from the fold line 341 along tear line 376 to the approximately 90° turn to extend along tear line 374 through fold line 352 and into side panel end flap 342 to extend along tear line 372 to extend to a periphery portion of side panel end flap 342.

Figure 22:
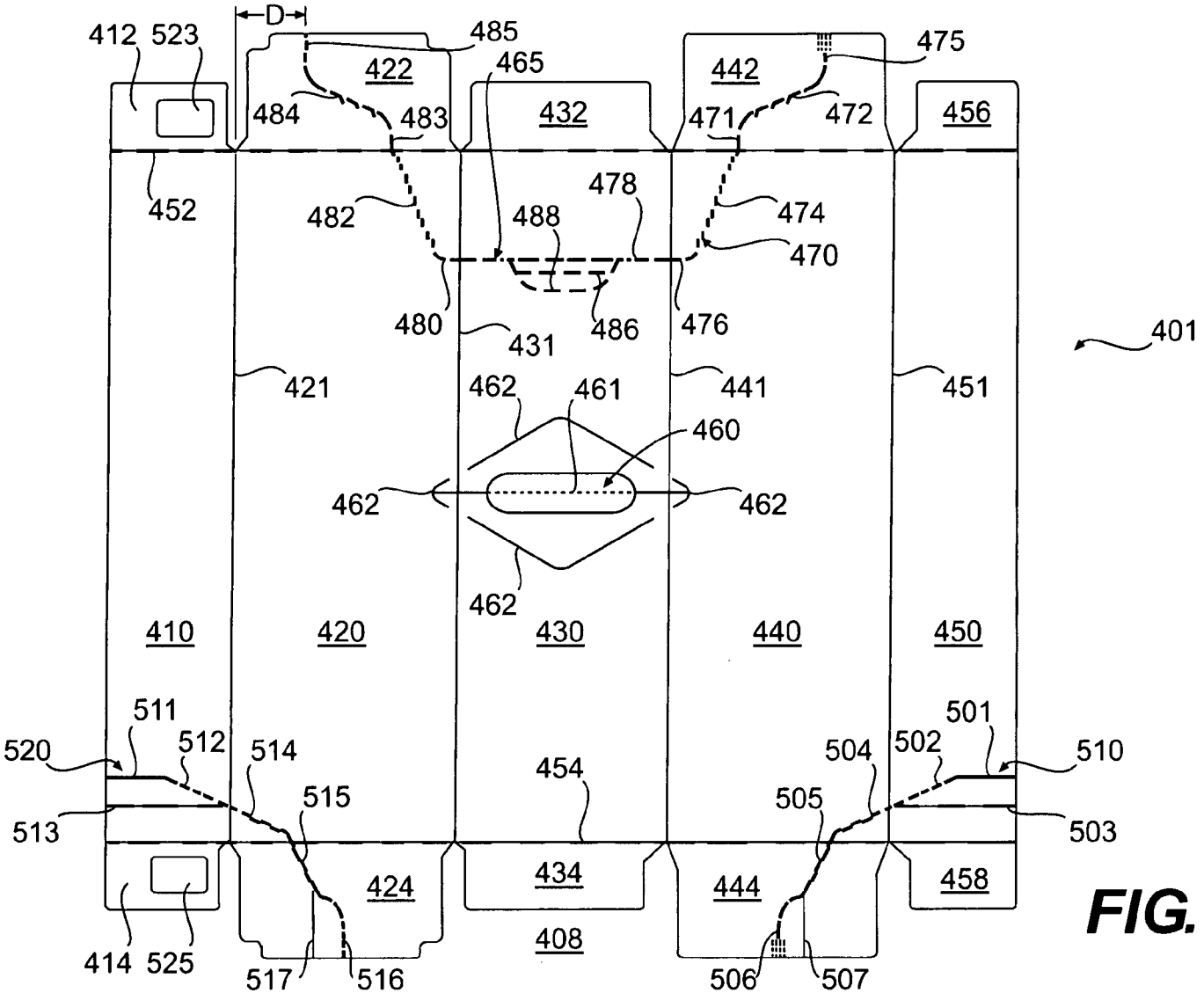
FIG. 22 is a plan view of still another alternate blank from which a carton can be formed according to the present invention.

FIG. 22 shows an alternate blank from which a carton can be formed. The blank 401 shown in FIG. 22 includes first bottom panel 410, side panel 420, top panel 430, side panel 440, and second bottom panel 450. The first bottom panel 410 is connected to side panel 420 along a fold line 421. Side panel 420 is connected to top panel 430 at a fold line 431. Top panel 430 is connected to side panel 440 at a fold line 441. Side panel 440 is connected to second bottom panel 450 at a fold line 451. The blank 401 of FIG. 22 includes a handle 460 with crease lines 462 and an access port 461 capable of receiving a hand, fingers, or other apparatus to engage the handle to allow movement or transport of the carton as desired.

Panels 410, 420, 430, 440, and 450 are connected to end flaps, which are separated therefrom by fold lines 452 and 454, which are substantially perpendicular to fold lines 421, 431, 441, and 451. The end flaps extend along a first marginal area 408 of the blank 401. Specifically, first bottom panel 410 is connected along fold line 452 to a bottom panel end flap 412 and connected along a fold line 454 to a bottom panel end flap 414. Side panel 420 is connected along fold line 452 to side panel end flap 422 and is connected to side panel end flap 424 along fold line 454. Top panel 430 is connected to top panel end flap 432 along fold line 452 and is connected to top panel end flap 434 along fold line 454. Side panel 440 is connected to side panel end flap 442 along fold line 452 and is connected to side panel end flap 444 along fold line 454. Second bottom panel 450 is connected to bottom panel end flap 456 along fold line 452 and is connected to bottom panel end flap 458 along fold line 454.

In the blank of FIG. 22, the opening portion 470 defined by a long tear line 465 is substantially similar to the opening portion 370 shown in the blank of FIG. 21, however, the tear line in the side panels 420 and 440 extend from the tear line 478 into side panels 420 and 440 then extend along and into the side panel end flaps 422 and 442. Specifically, the tear line 478 crosses the fold line 431 and enters the side panel 420 to extend a distance 480 along the tear line to turn at oblique angles to extend along a tear line 482 to intersect with the fold line 452 to extend a distance to turn at an oblique, steeper angle to extend along tear line 484 to turn and extend along the tear line 485 to the periphery of the side panel end flap 422. In the top panel 430, a finger flap 486 extends along perimeter 388 at tear line 478. The tear line in side panel 440 continues from the fold line 441 a distance 476 to turn at an oblique angle and continue along tear line 474 to intersect with fold line 452 and continue a distance in side panel end flap 442 along tear line 471 to turn at an oblique angle and extend along tear line 472 to turn and extend along tear line 475 to the periphery of side panel end flap 442. The distance D of opening feature 470 shown in FIG. 22 can be at the height analogous to the blanks shown in FIGS. 1, 7, 14, and 21 and generally will keep containers in the bottom row. Alternate heights are encompassed, such as those from the embodiments detailed above.

Also shown in the blank 401 of FIG. 22, a positioning feature is included. The positioning feature can optimally include a tilt or positioning assembly that can be engaged to place a rearward or non-exiting end of the carton at a height above the frontward or exiting end of the carton to allow cartons to proceed according to gravity feed toward the exiting end of the carton. As shown in the blank 401 of FIG. 22, the positioning feature generally includes two separate, but substantially similar fold lines adapted to create the positioning feature for the enclosed carton. As shown, the opening feature includes positioning feature portions 510 and 520 that, when the panels are adhesively connected, form a unitary positioning assembly or mechanism.

The positioning feature 510 includes a fold line 501 formed in the bottom panel 450 and extending toward a tear line 502, that intersects with fold line 451, and a tear line 504 that is formed in and extends along side panel 440 to intersect with fold line 454. The tear line 505 extends from tear line 504 along and though side panel end flap 444 to intersect with the tear line 506 that extends to a periphery of side panel end flap 444. Also included in side panel end flap 444 is a fold line 507 that enables creation of an access opening to detach the positioning feature from the blank or carton to form the positioning feature. Additionally, a fold line 503 can be included in bottom panel 450 to assist in the folding of the positioning assembly.

Positioning feature 520 as shown in FIG. 22 includes a fold line 511 formed in bottom panel 410 that extends to tear line 512 at an oblique angle from fold line 511 to fold line 421 between bottom panel 410 and side panel 420. Tear line 514 extends from fold line 421 to an intersection with fold line 454, intersecting with flap 424 that extends along a tear line 515 that extends along at an oblique angle with respect to tear line 514 to a tear line 516 that extends along a periphery of side panel end flap 424. A fold line 517 can be included in side panel end flap 424 to allow, in conjunction with fold line 507 and tear lines 506 and 516, creation of an access opening capable of assisting in the detachment of the positioning features 510 and 520 to enable formation and use of the positioning assembly in the enclosed carton. Also included in bottom panel 410 is a fold line 513 that assists fold lines 503, 510, and 520 to enable folding of the positioning feature along the bottom portion of the enclosed carton to place the positioning feature in a position to allow gravity feed of the containers toward the exiting end when the enclosed carton is disposed on a supporting surface. An embossed area 523 is formed in bottom panel end flap 412 and an embossed area 525 is formed in bottom panel end flap 414 to assist in formation of the carton from the blank 401. These embossed areas 523, 525 generally are glue assist areas that are raised slightly higher than areas surrounding embossed areas 523 and 525 in bottom panel end flaps 412 and 414. Embossing or otherwise pressing the blank 401 onto a raised block can form a slightly raised portion at approximately the same height of a 2-ply thickness at areas 523 and 525.

The positioning features can be engaged to enable the carton's rearward end to be elevated above a supporting surface, such as a counter, refrigerator shelf, or cabinet or shelf that is supporting the enclosed carton. When the carton is manually placed in its elevated position, the containers or articles in the enclosed carton accordingly will roll forwardly from the rearward end and toward the front, or exiting end, by gravity feed. The carton thus can be positioned to allow a user to dispense all articles in a front, or exiting end of the carton individually as they feed toward the exiting end. Generally, the positioning or tilt assembly can be engaged by accessing the access opening by detachment along tear lines 506 and 516 of the positioning features 510 and 520 and folding of the access opening along fold lines 507 and 517. Engagement of the positioning features typically includes pushing inwardly and/or pulling outwardly of the positioning feature to separate along tear lines. The tear lines 505 and 515 separate along side panel end flaps 444 and 424, respectively, with tear lines 504 and 514 further separating along side panels 440 and 420, respectively, to cause tear lines 502 and 512 in bottom panels 450 and 410, respectively, to also detach. The positioning features of the positioning assembly are then folded along fold lines 501, 511, 503, 513 to fit the positioning features in place. The carton is then elevated from the support surface and can be positioned in any manner to place the positioning or tilting feature in an operable position to force or otherwise encourage via gravity feed of the containers within the carton to proceed to the exiting end.

Figure 23:
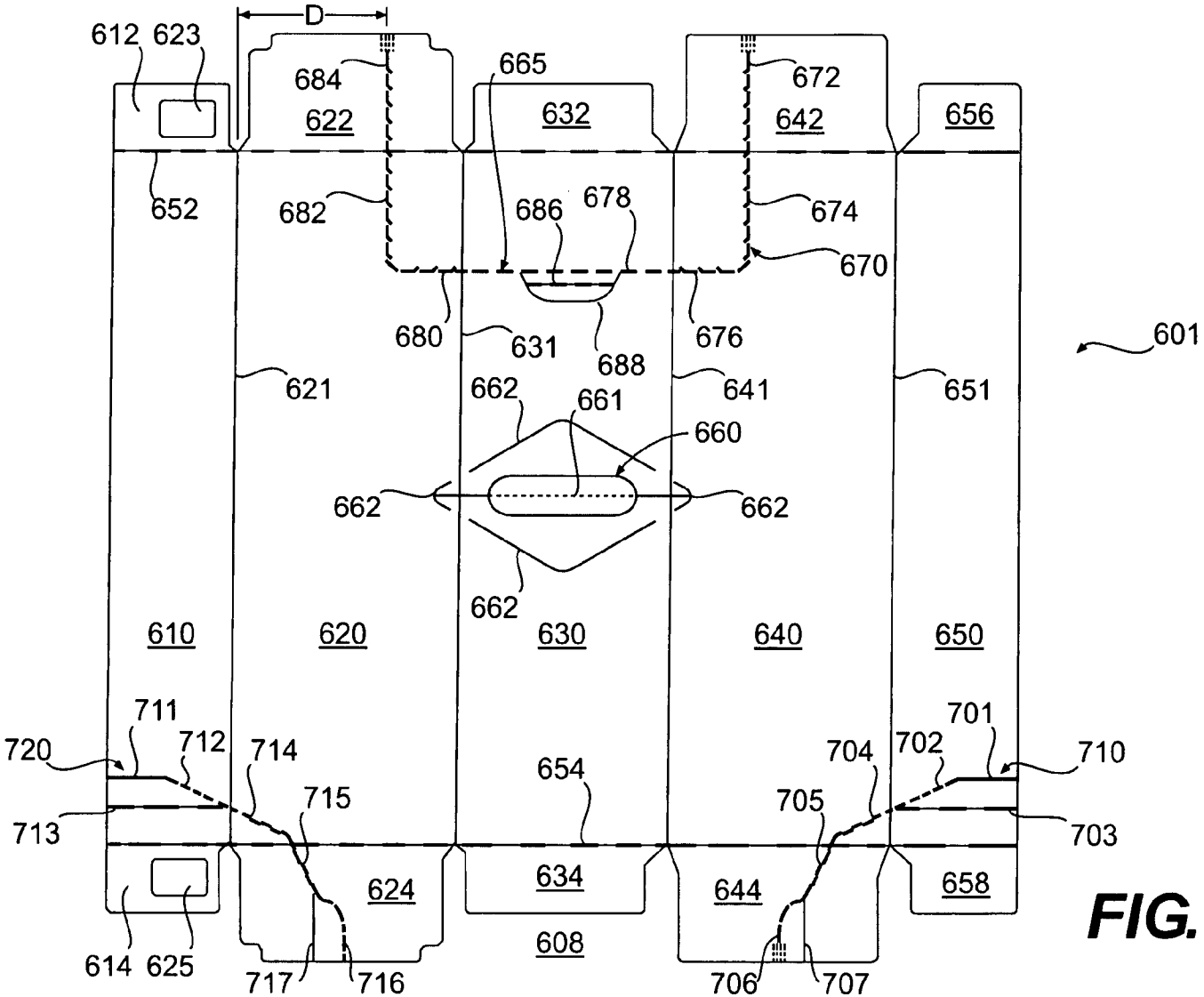
FIG. 23 is a plan view of another alternate blank from which a carton can be formed according to the present invention.

The blank 601 shown in FIG. 23 includes first bottom panel 610, side panel 620, top panel 630, side panel 640, and second bottom panel 650. The first bottom panel 610 is connected to side panel 620 along a fold line 621. Side panel 620 is connected to top panel 630 at a fold line 631. Top panel 630 is connected to side panel 640 at a fold line 641. Side panel 640 is connected to second bottom panel 650 at a fold line 651. The blank 601 of FIG. 23 also is shown as including a handle 660 with crease lines 662 and an access port 661 capable of receiving a hand, fingers, or other apparatus to engage the handle to allow movement or transport of the carton as desired.

Panels 610, 620, 630, 640, and 650 are connected to end flaps, which are separated therefrom by fold lines 652 and 654, which are substantially perpendicular to fold lines 621, 631, 641, and 651. The end flaps extend along a first marginal area 608 of the blank 601. Specifically, first bottom panel 610 is connected along fold line 652 to a bottom panel end flap 612 and connected along a fold line 654 to a bottom panel end flap 614. Side panel 620 is connected along fold line 652 to side panel end flap 622 and is connected to side panel end flap 624 along fold line 654. Top panel 630 is connected to top panel end flap 632 along fold line 652 and is connected to top panel end flap 634 along fold line 654. Side panel 640 is connected to side panel end flap 642 along fold line 652 and is connected to side panel end flap 644 along fold line 654. Second bottom panel 650 is connected to bottom panel end flap 656 along fold line 652 and is connected to bottom panel end flap 658 along fold line 654.

A tear line 665 is shown in blank 601 of FIG. 23 and extends through side panel end flaps 622 and 642, side panels 620 and 640, and top panel 630. When the carton is formed, the tear line is separable so as to create a detachable portion 670 that is openable to create an opening in the enclosed carton that allows removal of the containers enclosed therein. The detachable portion can remain hingedly attached or can be entirely removed from the carton. Along the tear line and formed in the top panel 630 is an access opening 686 formed along the tear line in the top panel and defining a perimeter opening at 688.

Generally the tear line 665 includes a series of sections or portions and extends across the top panel at 678 into each side panel a specified distance, in side panel 620 along tear line 680 and in side panel 640 along tear line 676. Generally, the tear line extends at a non-oblique angle for each of the side panels, extending substantially perpendicular, or at an approximately ninety-degree (90°) angle to the top panel, with the tear line proceeding through the side panels, into, and through the respective side panel end flaps. Accordingly, the tear line 676 intersects with tear line 674 formed in side panel 640 to intersect with fold line 652 and extend into side panel end flap 642 along a tear line 672 to an outer periphery thereof. Similarly, a tear line 680 extends through side panel 620 to tear line 682, also formed in side panel 620 and which extends to fold line 652 and into side panel end flap 622 along a tear line 684 to an outer periphery thereof.

The tear line generally extends in each side panel 620 and 640 a distance capable of forming the detachable portion while still retaining a bottom end container in the enclosed carton when the opening is created. This distance D shown in the figures generally can be in the range of about 105-200% (excluding the width of the blank—indicating that the actual height of D from the bottom panel or a supporting surface upon which the enclosed carton rests can be slightly greater than 200% of the diameter of a container and can be disposed, for example, in an portion, including portions adjacent the top panel, of a tear line that extends along fold lines 631, 641) of the diameter of the container in the side panels 620, 640, and can extend from a support surface SS upon which the enclosed carton is resting to retain the bottom row container in the enclosed carton (generally at fold line 621). Thus, this distance or height of the tear line into each side panel in FIG. 23 is greater than a diameter of a container in the enclosed carton and can be greater by a percentage of the diameter of the carton capable of retaining the container in the enclosed carton. Distance D can be any distance measured from fold line 621, up to and including fold lines 631 and 641. For example, this height can be 105%, 110%, 120%, 130%, 140%, 150%, 155%, 165%, 175%, 185%, 195%, or any increment or range of these percentages, including 200%. If the carton is formed to enclose more than two rows of containers, such as three or four rows, the height of the tear line in each side panel can be greater or lesser than these percentages.

The detachable portion 670 can be formed along a tear line substantially in the top panel, e.g. along the finger flap 686 at perimeter 688 along tear line 678 to, into, and along fold lines 631 and 641 to fold line 652. The tear line in this example could then either extend along the fold line 652 to form a detachable portion defined along tear line 678, a tear line extending along and through fold line 631, a tear line extending along and through fold line 641, and a tear line extending along and through fold line 652 at its intersection between top panel 630 and top panel end flap 632. Alternatively, the tear line in this example could extend across fold line 652 into the exiting end and into any combination of portions of side panel end flap 622, top panel end flap 632, and side panel end flap 642. This alternative could form the detachable portion defined along tear line 678, a tear line extending along and through fold line 631, a tear line extending along and through fold line 641, and into the exiting end in any configuration therein, including any combination of oblique, non-oblique, deep cut lines that extend to the bottom panel(s), or shallow cut lines that extend only partially into the exiting end toward the bottom panel(s).

Also shown in the blank 601 of FIG. 23, a positioning feature is included. The positioning feature, analogous to the positioning feature 510, 520 in FIG. 22, can optimally include a tilt or positioning assembly that can be engaged to place a rearward or non-exiting end of the carton at a height above the frontward or exiting end of the carton to allow cartons to proceed according to gravity feed toward the exiting end of the carton. As shown in the blank 601 of FIG. 23, the positioning feature generally includes two separate, but substantially similar fold lines adapted to create the positioning feature for the enclosed carton. As shown, the opening feature includes positioning feature portions 710 and 720 that, when the panels are adhesively connected, form a unitary positioning assembly or mechanism.

The positioning feature 710 includes a fold line 701 formed in the bottom panel 650 and extending toward a tear line 702, that intersects with fold line 651, and a tear line 704 that is formed in and extends along side panel 640 to intersect with fold line 654. The tear line 705 extends from tear line 704 along and though side panel end flap 644 to intersect with the tear line 706 that extends to a periphery of side panel end flap 644. Also included in side panel end flap 644 is a fold line 707 that enables creation of an access opening to detach the positioning feature from the blank or carton to form the positioning feature. Additionally, a fold line 703 can be included in bottom panel 650 to assist in the folding of the positioning assembly.

Positioning feature 720 as shown in FIG. 23 includes a fold line 711 formed in bottom panel 610 that extends to tear line 712 at an oblique angle from fold line 711 to fold line 621 between bottom panel 610 and side panel 620. Tear line 714 extends from fold line 621 to an intersection with fold line 654, intersecting with flap 624 that extends along a tear line 715 that extends along at an oblique angle with respect to tear line 714 to a tear line 716 that extends along a periphery of side panel end flap 624. A fold line 717 can be included in side panel end flap 624 to allow, in conjunction with fold line 707 and tear lines 706 and 716, creation of an access opening capable of assisting in the detachment of the positioning features 710 and 720 to enable formation and use of the positioning assembly in the enclosed carton. Also included in bottom panel 610 is a fold line 713 that assists fold lines 703, 710, and 720 to enable folding of the positioning feature along the bottom portion of the enclosed carton to place the positioning feature in a position to allow gravity feed of the containers toward the exiting end when the enclosed carton is disposed on a supporting surface. An embossed area 723 is formed in bottom panel end flap 612 and an embossed area 725 is formed in bottom panel end flap 614 to assist in formation of the carton from the blank 601. These embossed areas 723, 725 generally are glue assist areas that are raised slightly higher than areas surrounding embossed areas 723 and 725 in bottom panel end flaps 612 and 614. Embossing or otherwise pressing the blank 601 onto a raised block can form a slightly raised portion at approximately the same height of a 2-ply thickness at areas 723 and 725.

The positioning features can be engaged to enable the carton's rearward end to be elevated above a supporting surface, such as a counter, refrigerator shelf, or cabinet or shelf that is supporting the enclosed carton. When the carton is manually placed in its elevated position, the containers or articles in the enclosed carton accordingly will roll forward from the rearward end and toward the front, or exiting end, by gravity feed. The carton thus can be positioned to allow a user to dispense all articles in a front, or exiting end of the carton individually as they feed toward the exiting end. Generally, the positioning or tilt assembly can be engaged by accessing the access opening by detachment along tear lines 706 and 716 of the positioning features 710 and 720 and folding of the access opening along fold lines 707 and 717. Engagement of the positioning features typically includes pushing inwardly and/or pulling outwardly of the positioning feature to separate along tear lines. The tear lines 705 and 715 separate along side panel end flaps 644 and 624, respectively, with tear lines 704 and 714 further separating along side panels 640 and 620, respectively, to cause tear lines 702 and 712 in bottom panels 650 and 610, respectively, to also detach. The positioning features of the positioning assembly are then folded along fold lines 701, 711, 703, 713 to fit the positioning features in place. The carton is then elevated from the support surface and can be positioned in any manner to place the positioning or tilting feature in an operable position to force or otherwise encourage via gravity feed of the containers within the carton to proceed to the exiting end.

The depth of the detachable portion in the blanks 1, 101, 201, 301, 401, and 601 of the above embodiments can extend in the formed cartons to allow the containers C in the upper column or columns of the carton to be accessed. For example, the depth can be in the range of at 70-130% of the diameter of a container. Further, the cartons erected from the blanks 1, 101, 201, 301, 401, and 601 can enclose, for example, twelve 12-ounce containers C, or can be resized to enclose any number, variety, or orientation of containers desired.

The carton of the present invention encompasses configurations and descriptions the cartons commonly owned by the present assignee and specifically those detailed in U.S. Pat. Nos. 6,715,639; 6,604,677; 6,578,736; and 6,484,903; and U.S. patent application Ser. Nos. 10/789,792; 10/777,614; 10/626,234; and 10/271,447, all of which are incorporated by reference herein as if repeated in entirety herein.

The blanks according to the present invention can be, for example, formed from coated paperboard and similar materials. For example, the interior and/or exterior sides of the blanks can be coated with a clay coating. The clay coating may then be printed over with product specification, advertising, price coding, and other information or images. The blanks may then be coated with a varnish to protect any information printed on the blanks. The blanks also may be coated with, for example, a moisture barrier column, on either or both sides of the blanks. In accordance with the above-described embodiments, the blanks may be constructed of paperboard of a caliper such that it is heavier and more rigid than ordinary paper. The blanks also can be constructed of other materials, such as cardboard, hard paper, or any other material having properties suitable for enabling the dispensers to function at least generally as described above. The blanks can also be laminated to or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, the fold and/or tear lines used can include: score lines, such as lines formed with a blunt scoring knife, or the like, which creates a crushed portion in the material along the desired line of weakness; a cut that extends partially into a material along the desired line of weakness, and/or a series of cuts, nicks, perforations, indentations, or other creasing or lines of separation that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line or other line of disruption.

The above embodiments may be described as having one or panels adhered together by glue during erection of the carton embodiments. The term "glue" is intended to encompass all manner of adhesives commonly used to secure carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A blank for forming a carton comprising:

a first side panel;

a top panel;

a second side panel;

a bottom panel;

an adhesive flap;

at least one first end flap extending along a first marginal area of the blank;

at least one second end flap extending along a second marginal area of the blank;

a tear line extending through at least the top panel, the first side panel, and the second side panel, respectively, wherein the tear line extends from the top panel into the first side panel in a first direction substantially perpendicular to the top panel for a distance to a first turn; the tear line then extending a first run distance in a second direction to a second turn; the tear line then extending in the first direction for a first rise distance to a third turn; the tear line then extending in the second direction through the first side panel into a first side panel end flap and through the second side panel into a second side panel end flap, respectively; the first direction being substantially perpendicular to the second direction, the first turn, second turn, and third turn being in the first side panel.

2. The blank of claim 1, wherein the tear line extends into the first side panel a distance greater than halfway between a fold line that separates the top panel and the first side panel and a fold line that separates the first side panel from the adhesive flap.

3. The blank of claim 1, wherein the tear line extends into the second side panel a distance greater than halfway between a fold line that separates the top panel and the second side panel and a fold line that separates the second side panel from the bottom panel.

4. The blank of claim 1, including a finger flap formed in the top panel.

5. In combination, a substantially parallelepiped carton formed from the blank of claim 1 and a plurality of articles enclosed within the carton.

6. The blank of claim 1 wherein the tear line comprises a first portion extending from the top panel to the first turn, a second portion extending from the first turn to the second turn, a third portion extending from the second turn to the third turn, and a fourth portion extending from the third turn to the first side panel end flap.

7. A carton for enclosing a plurality of containers, the carton comprising:

a first side panel;

a top panel;

a second side panel;

a bottom panel;

an adhesive flap;

at least one first end flap extending along a first marginal area of the blank;

at least one second end flap extending along a second marginal area of the blank;

a tear line extending through at least the top panel, the first side panel, and the second side panel, respectively, wherein the tear line extends from the top panel into the first side panel in a first direction substantially perpendicular to the top panel for a distance to a first turn; the tear line then extending a first run distance in a second direction to a second turn; the tear line then extending in the first direction for a first rise distance to a third turn; the tear line then extending in the second direction through the first side panel into a first side panel end flap and through the second side panel into a second side panel end flap, respectively; the first direction being substantially perpendicular to the second direction, the first turn, second turn, and third turn being in the first side panel;

wherein separation of a detachable portion along the tear line creates an opening in the carton through which the containers can be removed.

8. The carton of claim 7, wherein the tear line extends into the first side panel a distance greater than halfway between a fold line that separates the top panel and the first side panel and a fold line that separates the first side panel from the adhesive flap.

9. The carton of claim 7, wherein the tear line extends into the second side panel a distance greater than halfway between a fold line that separates the top panel and the second side panel and a fold line that separates the second side panel from the bottom panel.

10. The carton of claim 7, including a finger flap formed in the top panel.

11. A method of removing articles from a carton, comprising:

providing the carton and plurality of articles according to claim 7;

tearing the carton along at least a part of the tear line;

removing a portion of the carton defined by the tear line to create an opening; and removing an article from the opening of the carton.

12. The carton of claim 7 wherein the tear line comprises a first portion extending from the top panel to the first turn, a second portion extending from the first turn to the second turn, a third portion extending from the second turn to the third turn, and a fourth portion extending from the third turn to the first side panel end flap.

13. A carton for enclosing a plurality of containers, the carton comprising:

a plurality of panels that extends at least partially around an interior of the carton, the plurality of panels comprises at least two side panels, a top panel, and a bottom panel;

at least two end flaps respectively foldably attached to respective panels of the plurality of panels, wherein the end flaps at least partially form a closed end of the carton;

a dispenser for allowing access to the containers in the carton, the dispenser comprising a detachable portion that is at least partially defined by a tear line in the carton and is for being at least partially removed for at least further opening a dispenser opening, the tear line comprising a first portion extending through the top panel and into at least one of the side panels in a first direction substantially perpendicular to the top panel, a second portion in the at least one side panel extending from the first portion in a second direction, a third portion in the at least one side panel extending from the second portion in the first direction, a fourth portion in the at least one side panel extending from the third portion in the second direction to one of the at least two end flaps, the first direction being substantially perpendicular to the second direction.

14. The carton of claim 13 wherein the tear line comprises a first turn at an intersection of the first portion and the second portion, a second turn at an intersection of the second portion and the third portion, and a third turn at an intersection of the third portion and the fourth portion.

* * * * *